US008165511B2

(12) United States Patent
Nakamura et al.

(10) Patent No.: US 8,165,511 B2
(45) Date of Patent: Apr. 24, 2012

(54) OFFSET CORRECTING DEVICE, INTERMEDIATE TRANSFERRING DEVICE, TRANSFERRING DEVICE, AND IMAGE FORMING APPARATUS

(75) Inventors: Tatsuya Nakamura, Saitama (JP); Masaki Suto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 407 days.

(21) Appl. No.: 12/557,162

(22) Filed: Sep. 10, 2009

(65) Prior Publication Data

US 2010/0247170 A1 Sep. 30, 2010

(30) Foreign Application Priority Data

Mar. 27, 2009 (JP) ..... P2009-080667

(51) Int. Cl.
*G03G 15/00* (2006.01)
*G03G 15/01* (2006.01)

(52) U.S. Cl. ..... 399/302; 399/165; 399/303; 198/806; 198/807; 198/810; 271/275; 474/108

(58) Field of Classification Search ..... 399/165, 399/302, 303; 198/806, 807, 810.01; 271/275; 474/108

See application file for complete search history.

(56) References Cited

U.S. PATENT DOCUMENTS

| | | | | |
|---|---|---|---|---|
| 5,181,888 | A | 1/1993 | Takahashi et al. | |
| 5,964,339 | A * | 10/1999 | Matsuura et al. | 198/810.03 |
| 6,141,525 | A * | 10/2000 | Tahara | 399/395 |
| 6,249,661 | B1 | 6/2001 | Saitoh et al. | 399/117 |
| 7,806,253 | B2 * | 10/2010 | Graswinckel et al. | 198/806 |
| 7,815,042 | B2 * | 10/2010 | Oishi | 198/837 |
| 2006/0119029 | A1 | 6/2006 | Kitamura | |
| 2006/0216056 | A1 * | 9/2006 | Okabe | 399/101 |
| 2007/0110471 | A1 | 5/2007 | Kitamura | 399/101 |
| 2007/0231021 | A1 * | 10/2007 | Kinoshita et al. | 399/301 |
| 2009/0245836 | A1 * | 10/2009 | Sato | 399/68 |
| 2010/0247174 | A1 * | 9/2010 | Hori et al. | 399/303 |

FOREIGN PATENT DOCUMENTS

| | | |
|---|---|---|
| JP | 04-133930 | 5/1992 |
| JP | 6-99055 B | 12/1994 |
| JP | 08-320634 | 12/1996 |
| JP | 2001-080782 | 3/2001 |
| JP | 2003-148446 | 5/2003 |
| JP | 2006-162659 | 6/2006 |
| JP | 2007-139921 | 6/2007 |
| JP | 2008-040397 | 2/2008 |
| JP | 2008-070706 | 3/2008 |
| JP | 2008-129494 | 6/2008 |
| JP | 2009-181107 | 8/2009 |
| JP | 2009-210702 | 9/2009 |
| JP | 2009-258494 | 11/2009 |

* cited by examiner

*Primary Examiner* — David Gray
*Assistant Examiner* — Francis Gray
(74) *Attorney, Agent, or Firm* — Morgan, Lewis & Bockius LLP

(57) ABSTRACT

An offset correcting device includes: an endless belt-like member having an endless belt-like shape; a rotation supporting member that has a rotation shaft in which an axial direction extends along a width direction of the endless belt-like member, and that is rotated while supporting the endless belt-like member; an interlocking member that is supported by one end portion of the rotation shaft to be movable along the axial direction, and that is capable of being contacted with a width direction edge of the endless belt-like member; and a shaft displacing member as defined herein.

12 Claims, 15 Drawing Sheets

OFFSET CORRECTING DEVICE, INTERMEDIATE TRANSFERRING DEVICE, TRANSFERRING DEVICE, AND IMAGE FORMING APPARATUS

CROSS-REFERENCE TO RELATED APPLICATIONS

This application is based on and claims priority under 35 USC 119 from Japanese Patent Application No. 2009-080667 filed on Mar. 27, 2009.

BACKGROUND

Technical Field

The present invention relates to an offset correcting device, an intermediate transferring device, a transferring device, and an image forming apparatus.

SUMMARY

According to an aspect of the invention, there is provided an offset correcting device including: an endless belt-like member having an endless belt-like shape; a rotation supporting member which has a rotation shaft in which an axial direction extends along a width direction of the endless belt-like member, and which is rotated while supporting the endless belt-like member; an interlocking member which is supported by one end portion of the rotation shaft to be movable along the axial direction, and which can be contacted with a width direction edge of the endless belt-like member; and a shaft displacing member which has: a swing center that is placed at a position deviated from the rotation shaft, and that intersects with the axial direction; a rotation shaft contacting portion which is contacted with the one end portion of the rotation shaft of the rotation supporting member; and an interlocking member contacting portion which is contacted with the interlocking member, which is movable integrally with the rotation shaft contacting portion, and in which, when the interlocking member is pressed against the width direction edge of the endless belt-like member that is moved to one end side of the rotation shaft, the interlocking member contacting portion and the rotation shaft contacting portion are swung about the swing center, and the rotation shaft contacting portion tilts the rotation shaft in a tilting direction coincident with a direction along which the endless belt-like member is moved toward another end of the rotation shaft.

BRIEF DESCRIPTION OF THE DRAWINGS

Exemplary embodiments of the present invention will be described in detail based on the following figures, wherein:

FIG. 6A is a perspective view of the belt module in a state where a front plate of a belt support frame and a medium conveying belt are removed from the belt module, FIG. 6B is an enlarged view of main portions of a pressing member position adjustment long hole, and FIG. 6C is a view illustrating a pin pressing device;

FIG. 11A is an enlarged view as seen in the direction of arrow XIA in FIG. 10A, FIG. 11B is an enlarged view as seen in the direction of arrow XIB in FIG. 11A, FIG. 11C is an enlarged view as seen in the direction of arrow XIC in FIG. 11B, and FIG. 11D is an enlarged perspective view as seen in the direction of arrow XID in FIG. 11C;

FIG. 13A is a sectional perspective view corresponding to FIG. 10A in Example 1, and illustrating a range from a front end portion of a driven roll to a front bearing, and FIG. 13B is a diagram of a swing bracket as seen in the direction of arrow XIIIB in FIG. 13A;

FIG. 14A is a sectional perspective view corresponding to FIG. 13A in Example 2, and illustrating a range from a front end portion of a driven roll to a front bearing, and FIG. 14B is an enlarged view illustrating main portions of the belt offset sensing member and the shaft displacing member as seen in the direction of arrow XIVB in FIG. 14A.

DESCRIPTION OF REFERENCE NUMERALS AND SIGNS

Figure 1:
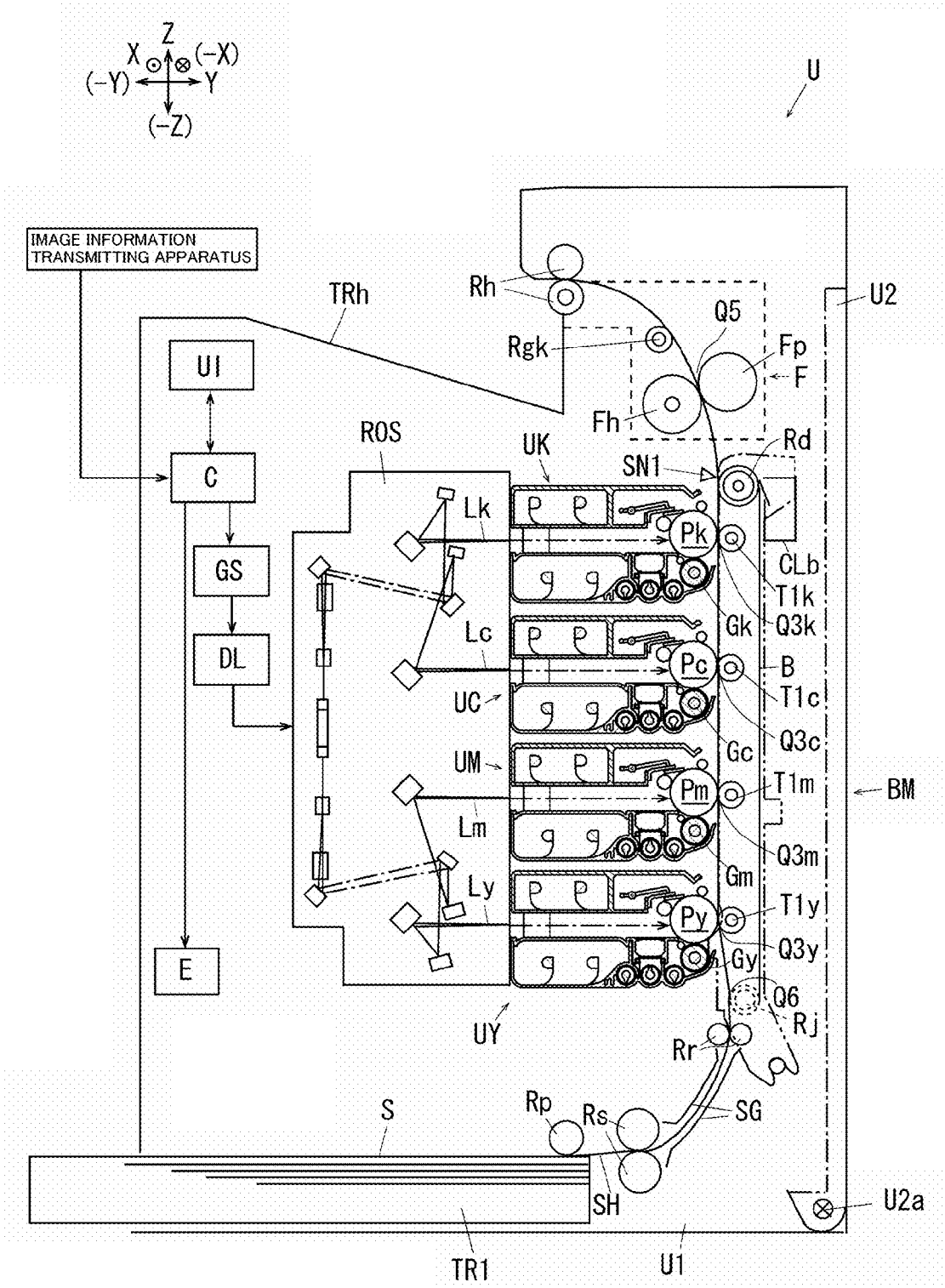
FIG. 1 is a diagram of the whole of an image forming apparatus of Example 1 of the invention.

θ . . . increment angle, $\theta_0$ . . . angle formed by width direction line and shaft displacement line segment, 9 . . . center mounting portion, 9*a* . . . inner circumferential face, 9*b* . . . cutout insertion portion, 12, 12 . . . frame mounting portion, 26 . . . interlocking member, 27 . . . shaft displacing member, 27*a* . . . swing center, 27*a*1, 27*a*2 . . . cutout face, 27*e* . . . rotation shaft contacting portion, plate-like member, convex arcuate face, (27*f*+27*g*) . . . interlocking member contacting portion, 27*h* . . . contacting face, AR1 . . . movement range of interlocking member contacting portion, AR2 . . . swing range of swing center, B . . . endless belt-like member, BM . . . offset correcting device, F . . . fixing device, Fb . . . second frame, Ft, Ft' . . . first frame, Gy to Gk . . . developing device, L . . . length of shaft displacement line segment, L1 . . . opening width, L2 . . . cutout distance, Lx . . . moving distance of endless belt-like member in width direction, Ly . . . moving distance of rotation shaft in tilting direction, $P_0$ . . . pre-movement contacting portion contact position, $P_{max}$ . . . maximum post-movement contacting portion contact position, Py to Pk . . . image carrier, $r_0$ . . . shaft displacement line segment, r1 . . . diameter of column, Rj . . . rotation supporting member, Rja . . . rotation shaft, S . . . medium, $x_0$ . . . width direction line, U . . . image forming apparatus.

DETAILED DESCRIPTION

Next, examples which are specific examples (hereinafter, referred to as examples) of an exemplary embodiment of the invention will be described with reference to the drawings. However, the invention is not restricted to the following examples.

In order to facilitate the understanding of the following description, the front and rear directions in the drawings are indicated as X-axis directions, the right and left directions are indicated as Y-axis directions, and the upper and lower directions are indicated as Z-axis directions. The directions or sides indicated by the arrows X, −X, Y, −Y, Z, and −Z are the front, rear, right, left, upper, and lower directions, or the front, rear, right, left, upper, and lower sides, respectively.

In the figures, the symbol in which "●" is written in "○" indicates the arrow which is directed from the rear of the sheet to the front, and that in which "x" is written in "○" indicates the arrow which is directed from the front of the sheet to the rear.

In the following description with reference to the drawings, illustrations of members other than those which are necessary in description are suitably omitted for the sake of easy understanding.

Example 1

FIG. 1 is a diagram of the whole of an image forming apparatus of Example 1 of the invention.

Referring to FIG. 1, in a printer U which is an example of an image forming apparatus of Example 1 of the invention, a sheet feed container TR1 for housing recording sheets S functioning as an example of media on which an image is to be recorded is disposed in a lower portion, and a sheet discharging portion TRh is disposed on the upper face. An operation unit UI is disposed in an upper portion of the printer U.

Referring to FIG. 1, the printer U of Example 1 has: an image forming apparatus main unit U1; and an opening/closing portion U2 which is openable and closable about a swing center U2*a* disposed in a right lower end portion of the image forming apparatus main unit U1. The opening/closing portion U2 is configured so as to be movable between an open position (not shown) where the interior of the image forming apparatus main unit U1 is opened in order to replace a process cartridge that will be described later, or remove a jammed recording sheet S, and a normal position where the portion is held in a normal state in which the image forming operation shown in FIG. 1 is performed.

The printer U has a controller C which performs various controls on the printer U, an image processing portion GS in which the operation is controlled by the controller C, an image writing device driving circuit DL, a power supplying device E, and the like. The power supplying device E applies voltages to charging rollers CRy to CRk which are an example of a charging device that will be described later, developing rollers G1*y* to G1*k* which are an example of a developer holding member, transferring rollers T1*y* to T1*k* which are an example of a transferring device, etc.

The image processing portion GS converts print information supplied from an external image information transmitting apparatus or the like, to image information for forming latent images corresponding to four color images of K: black, Y: yellow, M: magenta, and C: cyan, and outputs the image information to the image writing device driving circuit DL at a predetermined timing. The image writing device driving circuit DL outputs a driving signal to a latent image writing device ROS in accordance with the supplied image information for the respective colors. The latent image writing device ROS emits laser beams Ly, Lm, Lc, Lk which are an example of image writing light for writing color images, in accordance with the driving signal.

Referring to FIG. 1, on the right side of the latent image writing device ROS, visible image forming devices UY, UM, UC, UK which are an example of an image recording portion for recording toner images of Y, M, C, and K that are an example of color visible images are placed.

Figure 2:
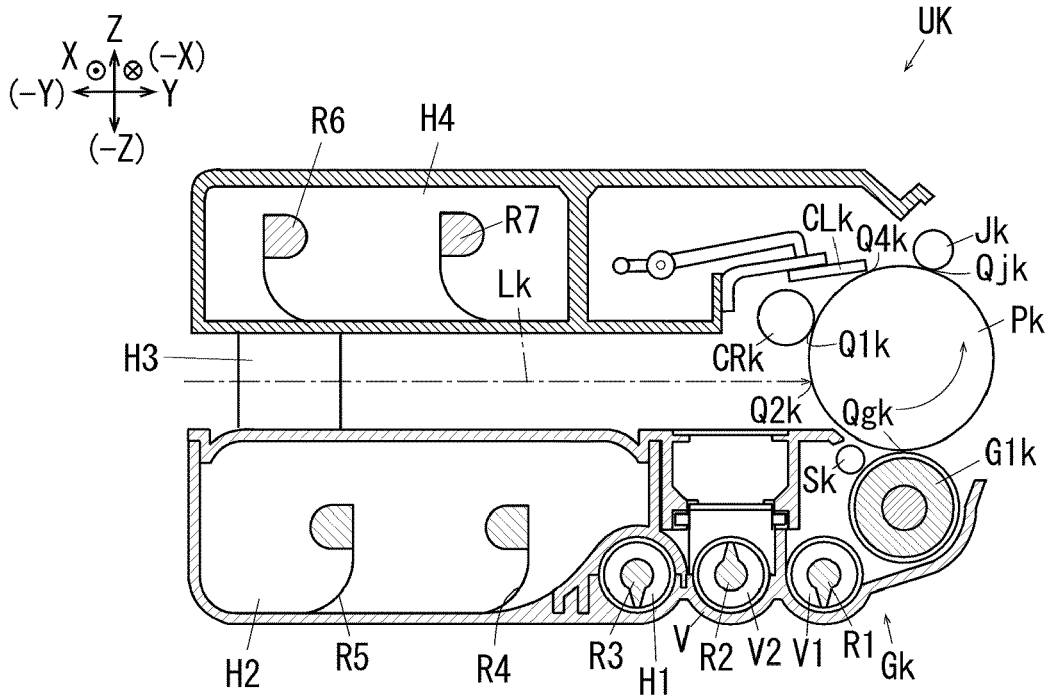
FIG. 2 is a view illustrating a visible image forming device which is an example of a detachable body in Example 1 of the invention.

FIG. 2 is a view illustrating a visible image forming device which is an example of a detachable body in Example 1 of the invention.

Referring to FIG. 2, the visible image forming device UK for K: black has a photosensitive member Pk which is an example of a rotating image carrier. In the periphery of the photosensitive member Pk, arranged are: a charging roll CRk which is an example of a charging device; a developing device Gk which develops an electrostatic latent image on the surface of the photosensitive member to a visible image; a discharging member Jk which discharges the surface of the photosensitive member Pk; a photosensitive member cleaner CLk which removes a developer remaining on the surface of the photosensitive member Pk, and which is an example of an image carrier cleaner; and the like. The developing device Gk has a developer container V which houses a developer, and a developing roll G1*k* which is rotated while holding the developer housed in the developer container V, and which is an example of a developer holding member. In the developer container V, a layer thickness restricting member Sk which is opposed to the developing roll G1*k*, and which restricts the layer thickness of the developer on the surface of the developing roll G1*k* is disposed.

The developer container V has stirring and conveying chambers V1, V2 in which the developer to be supplied to the developing roll G1*k* is conveyed while being stirred. Circulating and conveying R1, R2 which circularly convey the developer are placed in the stirring and conveying chambers V1, V2. A developer replenishing path H1 through which the developer is replenished is connected to the left stirring and conveying chamber V2, and a first developer replenishing chamber H2 which houses the developer for replenishment is connected to the developer replenishing path H1. The first developer replenishing chamber H2 is connected to a second developer replenishing chamber H4 which is above placed, through a developer replenishment connecting path H3. Replenishing developer carrying members R3, R4, R5, R6, R7 which convey the developer toward the stirring and conveying chambers V1, V2 are placed in the developer replenishing path H1, the first developer replenishing chamber H2, the developer replenishment connecting path H3, and the second developer replenishing chamber H4, respectively. The members denoted by the reference numerals H1 to H4 and R3 to R7 constitute developer replenishment containers H1 to H4+R3 to R7 in Example 1.

In the photosensitive member Pk, after the surface is uniformly charged by the charging roll CRk in a charging region Q1*k* opposed to the charging roll CRk, a latent image is written by the laser beam Lk in a latent image forming region Q2*k*. The written electrostatic latent image is visualized in a developing region Qgk opposed to the developing device Gk.

The visible image forming device UK for black in Example 1 is configured by a detachable body, or a so-called process cartridge UK to which the photosensitive member Pk, the charging device CRk, the developing device Gk, the discharging member Jk, the photosensitive member cleaner CLk, the developer replenishment containers H1 to H4+R3 to R7, and the like are detachably attached in an integral manner. The visible image forming device is configured so as to be attachable to and detachable from the image forming apparatus main unit U1 in a state where the opening/closing portion U2 is moved to the open position.

In the same manner as the visible image forming device UK for black, the visible image forming devices UY, UM, UC for the other colors are configured by detachable bodies which attachable to and detachable from the image forming apparatus main unit U1, or so-called process cartridges UY, UM, UC. In the printer U of Example 1, the process cartridges UY to UK are arranged in the upper and lower directions.

Referring to FIG. 1, on the right side of the photosensitive members Py to Pk, a belt module BM which is an example of the offset correcting device is placed. The belt module BM has an endless medium conveying belt B which is opposed to the process cartridges UY to UK, which is an example of an endless belt-like member, and which is an example of a medium conveying member. The medium conveying belt B is rotatably supported by a belt supporting roll Rd+Rj which is an example of a belt-like member supporting member, and which includes: a belt driving roll Rd that is an example of a driving member; and a driven roll Rj that is an example of a rotation supporting member, and that is an example of a driven member. The belt module BM further has transferring rolls T1*y*, T1*m*, T1*c*, T1*k* which are opposed to the photosensitive members Py to Pk that are an example of an opposing member, across the medium conveying belt B, and which are an example of a transferring device. The endless belt-like member is an endless member having a belt-like shape as described above, and includes a member which conveys a medium while holding the medium on the surface, and that which conveys a visible image formed by the visible image forming device while holding the image on the surface.

An image density sensor SN1 for detecting the density of an image which is formed at a predetermined timing by an image density adjusting unit (not shown) of the controller C, i.e., a so-called patch image is placed on the downstream side in the medium conveying direction of the medium conveying belt B, i.e., on the upper side. On the basis of the image density detected by the image density sensor SN1, the image density adjusting unit of the controller C adjusts the voltages to be applied to charging rollers CRy to CRk, the developing devices Gy to Gk, and the transferring rolls T1*y* to T1*k*, and the intensities of the latent image writing light beams Ly to Lk, thereby performing adjustment and correction of the image density, or a so-called process control.

A belt cleaner CLb which is an example a conveying member cleaner is placed on the downstream side of the image density sensor SN1 in the medium conveying direction of the medium conveying belt B.

The recording sheet S in the sheet feed container TR1 which is placed below the medium conveying belt B is picked up by a pickup roll Rp which is an example of a medium picking up member, separated one by one by separating rolls Rs which are an example of a medium separating member, and then conveyed to a recording medium conveying path SH configured by a sheet guide SG which is an example of a guiding member.

The recording sheet S in the recording medium conveying path SH is sent to registration rolls Rr which are an example of a feeding means, and which adjust the timing of feeding the sheet to the medium conveying belt B. The registration rolls Rr feed the recording sheet S at a predetermined timing to a recording medium attracting position Q6 which is a region opposed to the driven roll Rj. The recording sheet S conveyed to the recording medium attracting position Q6 is electrostatically attracted to the medium conveying belt B. In the belt module BM in Example 1, a guiding member for guiding the recording sheet S is omitted between the registration rolls Rr and the medium conveying belt B.

The recording sheet S attracted to the medium conveying belt B is gradually passed through transferring regions Q3*y*, Q3*m*, Q3*c*, Q3*k* where the sheet is contacted with the photosensitive members Py to Pk.

In the transferring regions Q3*y* to Q3*k*, a transfer voltage the polarity of which is opposite to the charge polarity of the toner is applied from the power supplying device E controlled by the controller C to the transferring rolls T1*y* to T1*k* which are placed on the rear face side of the medium conveying belt B.

In the case of a multi-color image, the toner images on the photosensitive members Py to Pk are overlappingly transferred onto the recording sheet S on the medium conveying belt B by the transferring rolls T1*y* to T1*k*. In the case of a so-called monochromatic image, only a black toner image is formed on the photosensitive member Pk, and only the toner image of K: black is transferred to the recording sheet S by the transferring device T1*k*.

After the transfer of the toner image, the photosensitive members Py to Pk are discharged by the discharging members Jy to Jk in discharging regions Qjy to Qjk, and then cleaned by recovering toners remaining on the surfaces by the photosensitive member cleaners CLy to CLk in cleaning regions Q4*y* to Q4*k*. The photosensitive members are again charged by the charging rollers CRy to CRk.

The recording sheet S onto which the toner images are transferred undergoes fixation in a fixing region Q5 where a heating roll Fh which is an example of a heating and fixing member of a fixing device F, and a pressurizing roll Fp which is an example of a pressurizing and fixing member are pressingly contacted each other. The recording sheet S onto which the images are fixed is guided by a guiding roller Rgk which is an example of a discharge guiding member, and then discharged from discharging rollers Rh which are an example of a medium discharging member, to a medium discharging portion TRh.

After the recording sheet S is separated from the medium conveying belt B, the medium conveying belt is cleaned by the belt cleaner CLb.

Description of Belt Module BM in Example 1

Figure 3:
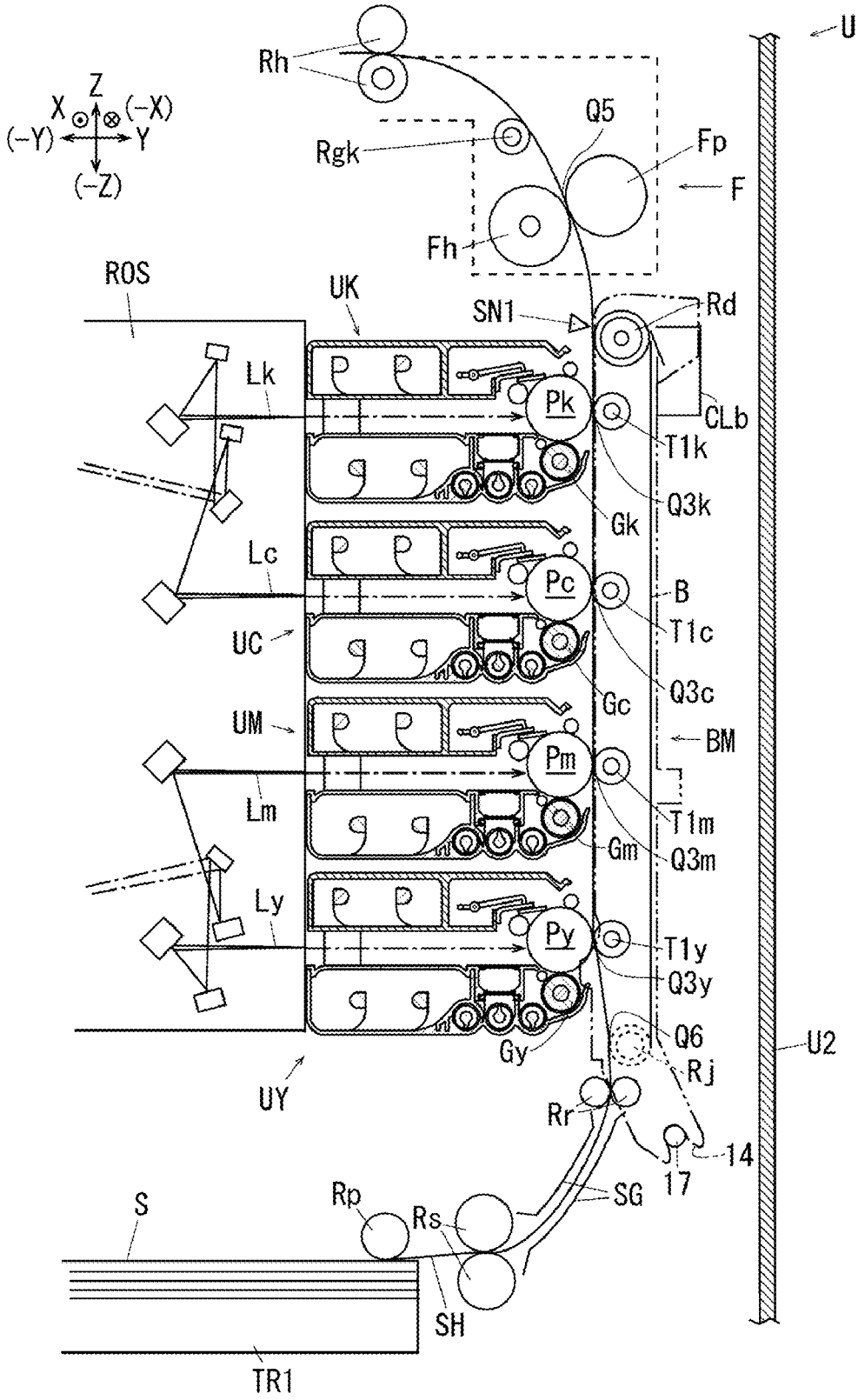
FIG. 3 is an enlarged view of main portions of the image forming apparatus of Example 1, and showing a state where a belt module is held at a use position.

FIG. 3 is an enlarged view of main portions of the image forming apparatus of Example 1, and showing a state where the belt module is held at a use position.

Figure 4:
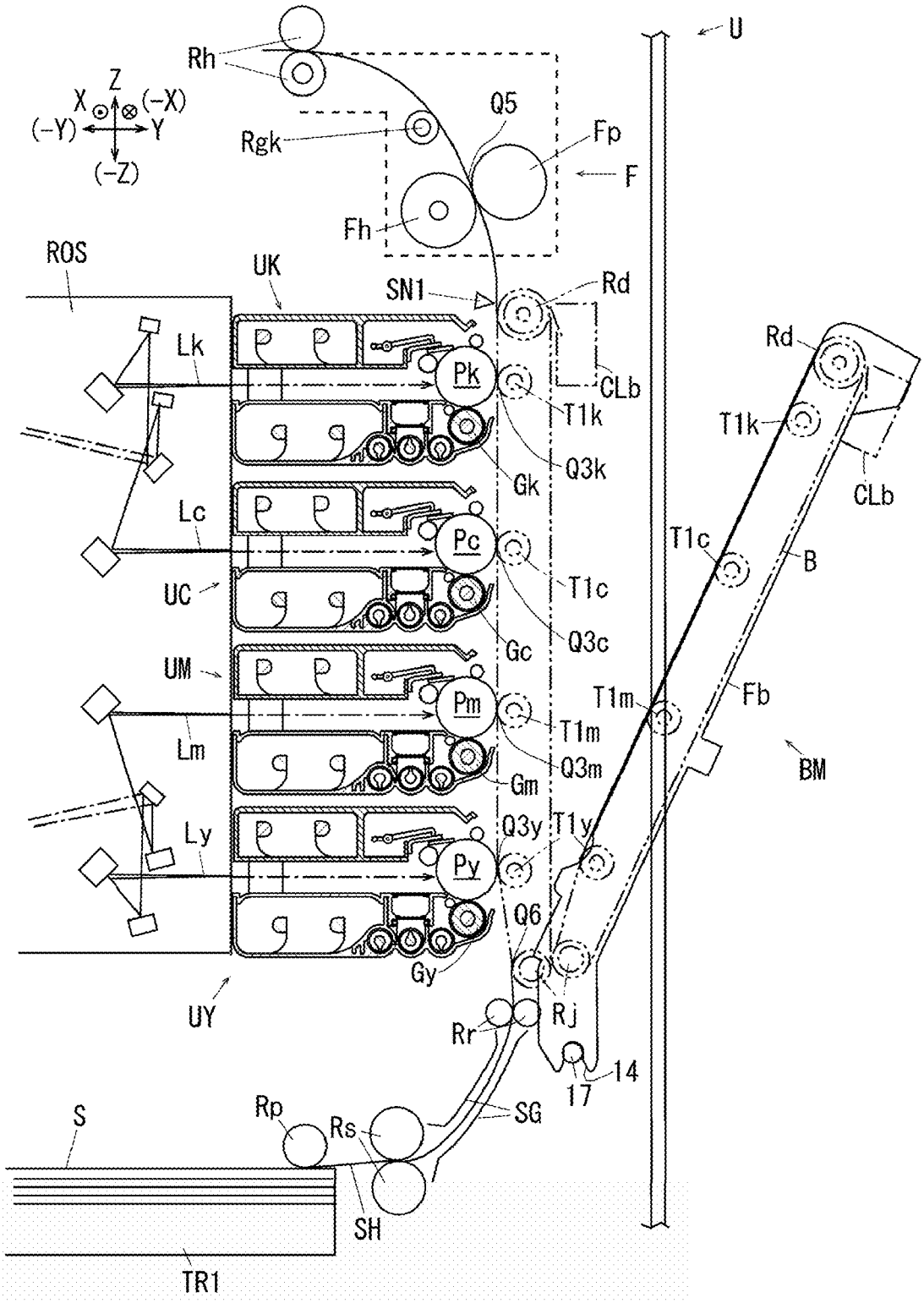
FIG. 4 is an enlarged view of main portions of the image forming apparatus of Example 1, and showing a state where the belt module is moved to a maintenance work position.

FIG. 4 is an enlarged view of main portions of the image forming apparatus of Example 1, and showing a state where the belt module is moved to a maintenance work position.

Figure 5:
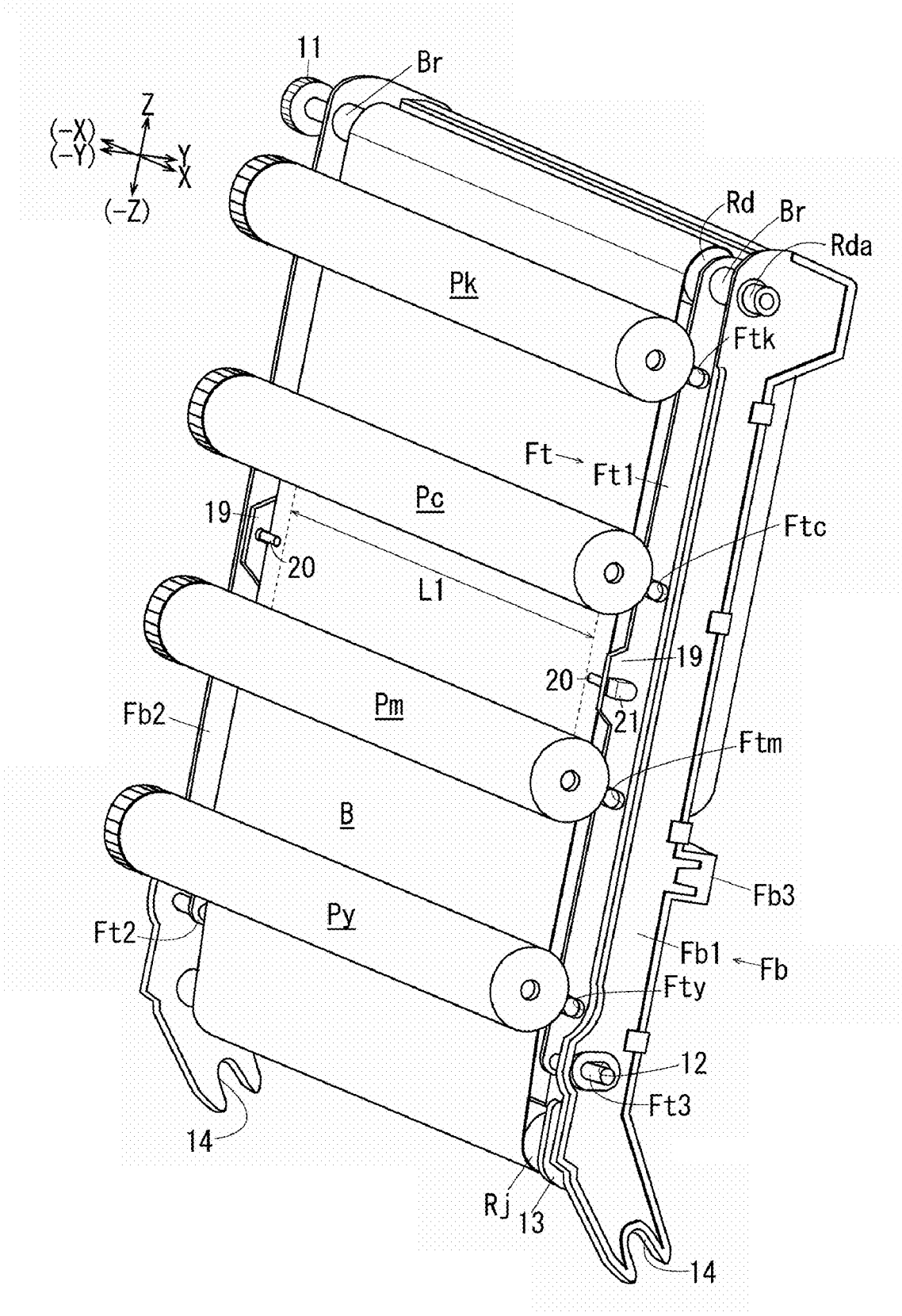
FIG. 5 is a perspective view of the belt module in Example 1, and showing positional relationships between image carriers and transferring rolls of the belt module.

FIG. 5 is a perspective view of the belt module in Example 1, and showing positional relationships between the image carriers and the transferring rolls of the belt module.

Figure 6A:
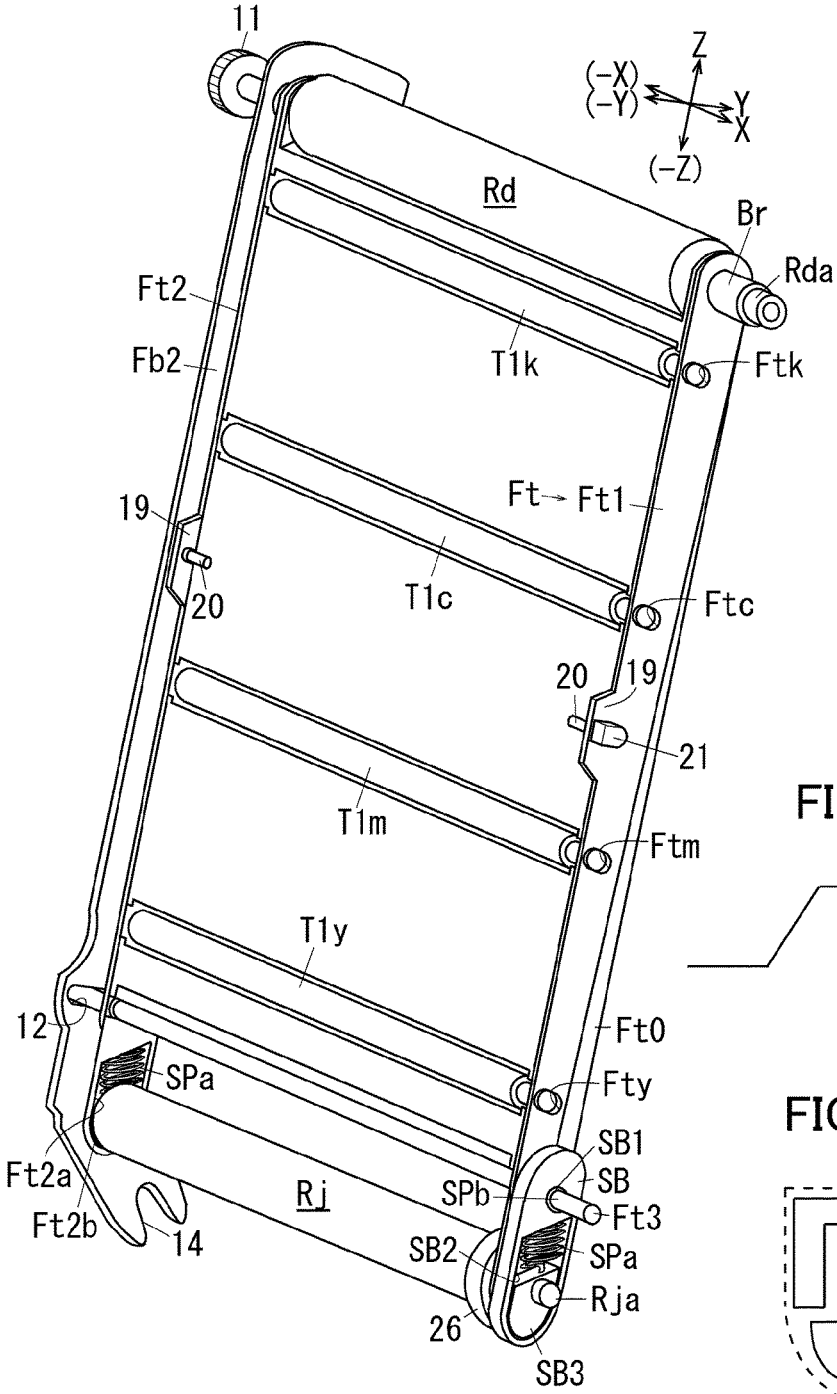
FIGS. 6A to 6C are views illustrating the belt module in Example 1.
Figure 6B:
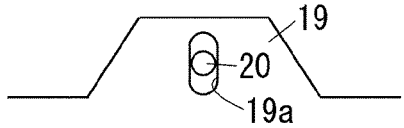
Figure 6C:
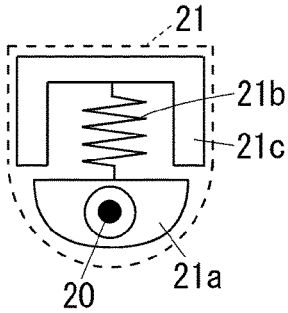

FIGS. 6A to 6C are views illustrating the belt module in Example 1, FIG. 6A is a perspective view of the belt module in a state where a front plate of a belt support frame and the medium conveying belt are removed from the belt module, FIG. 6B is an enlarged view of main portions of a pressing member position adjustment long hole, and FIG. 6C is a view illustrating a pin pressing device.

Figure 7:
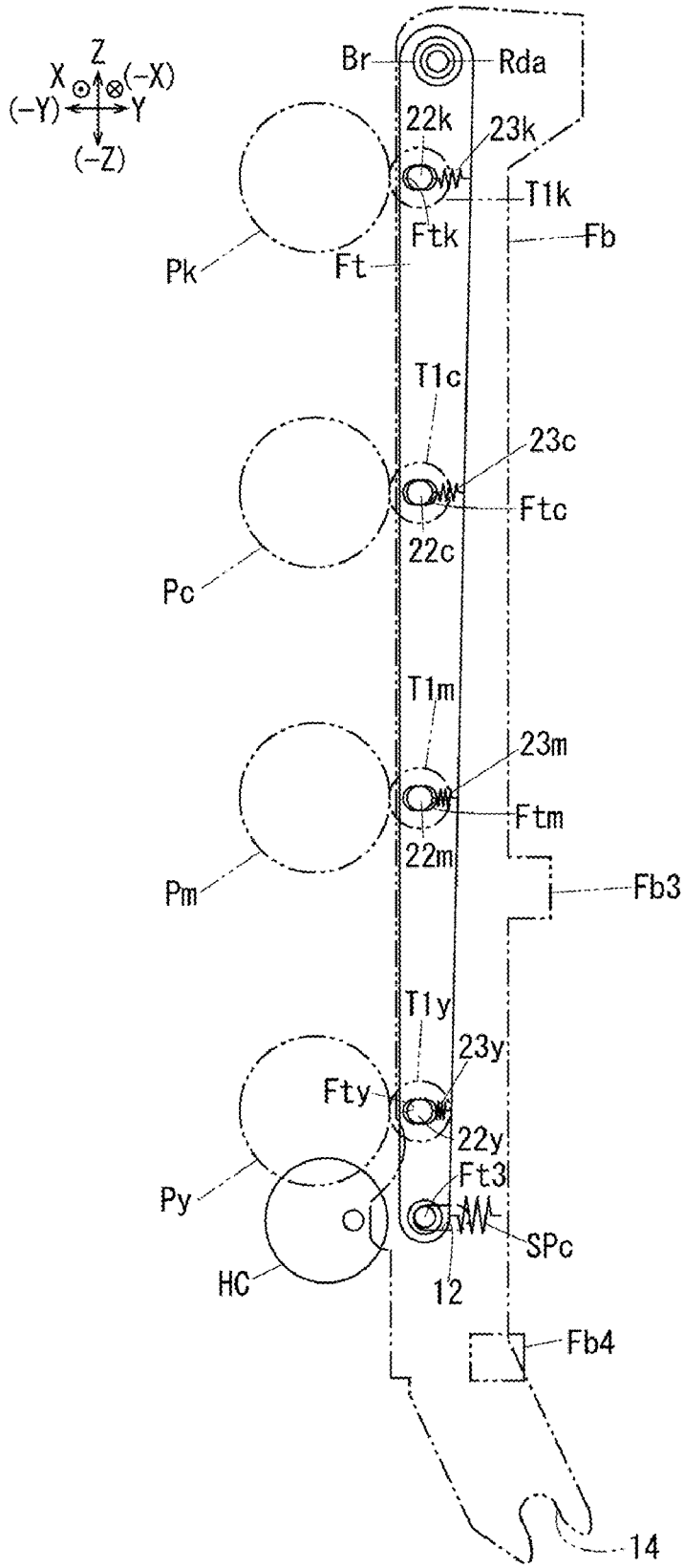
FIG. 7 is a side view of the belt module in Example 1, and showing a state where a transfer frame is held at a pressing position.

FIG. 7 is a side view of the belt module in Example 1, and showing a state where a transfer frame is held at a pressing position.

Figure 8:
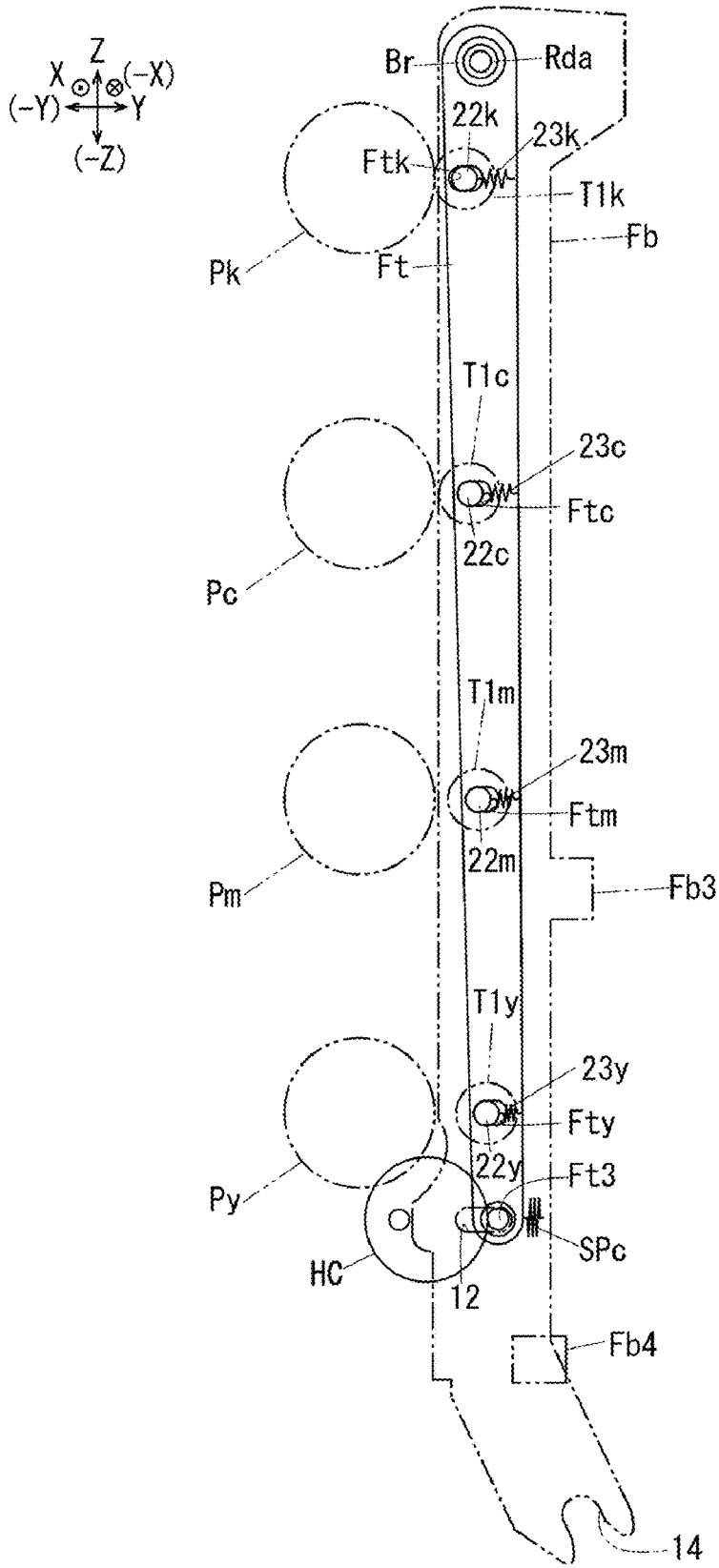
FIG. 8 is a side view of the belt module in Example 1, and showing a state where the transfer frame is moved to a separation position.

FIG. 8 is a side view of the belt module in Example 1, and showing a state where the transfer frame is moved to a separation position.

Figure 9:
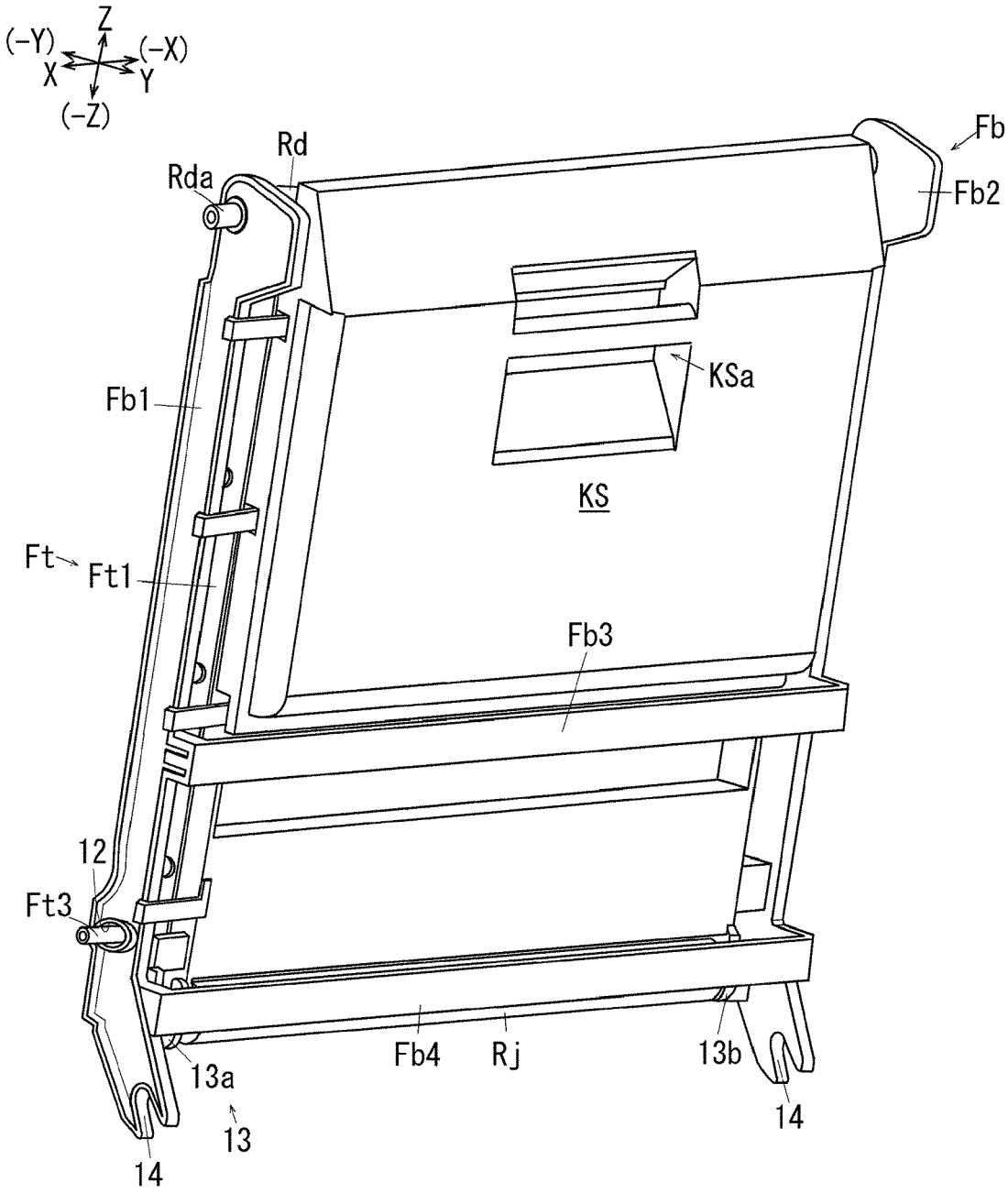
FIG. 9 is a perspective view of the belt module in Example 1, and showing a state where the medium conveying belt is removed from the belt module.

FIG. 9 is a perspective view of the belt module in Example 1, and showing a state where the medium conveying belt is removed from the belt module.

Figure 10A:
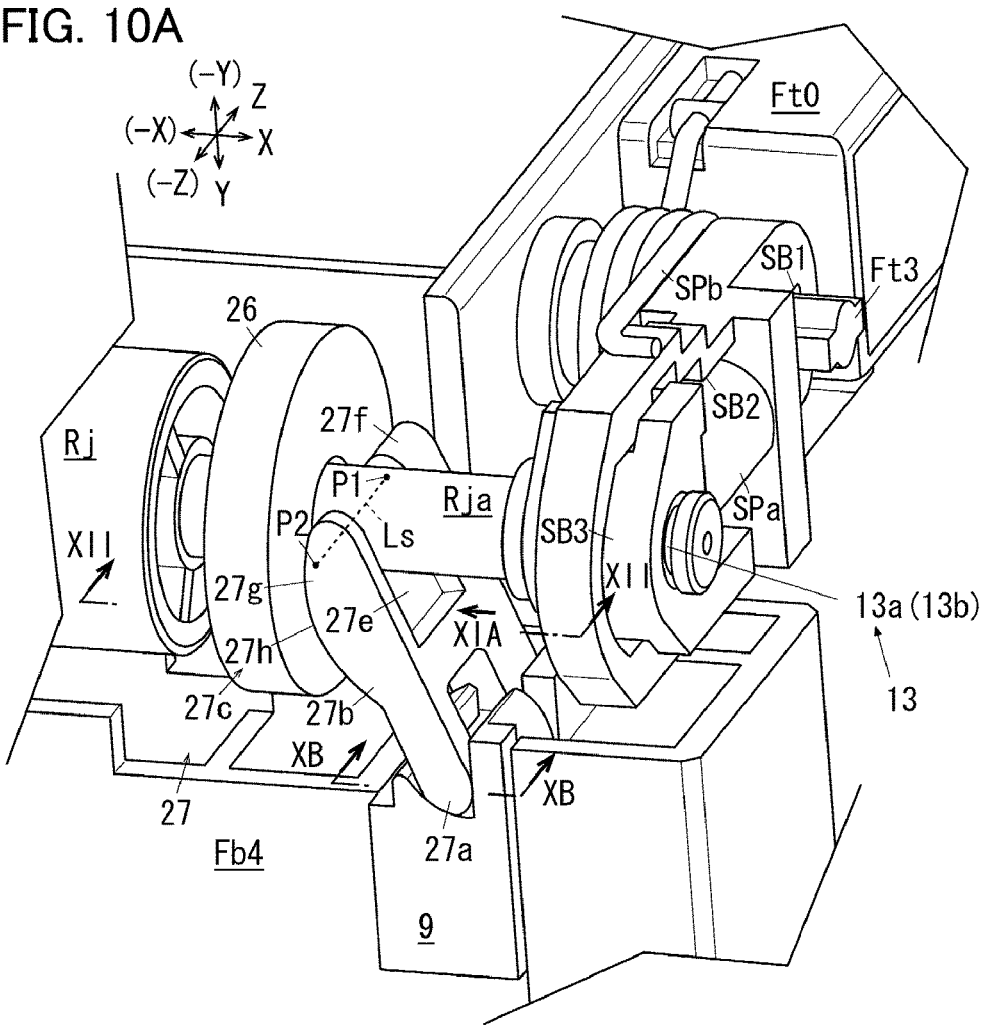
FIG. 10A is an enlarged perspective view of a belt offset sensing member and a shaft displacing member in Example 1, and illustrating a range from a front end portion of a driven roll to a front bearing.
Figure 10B:
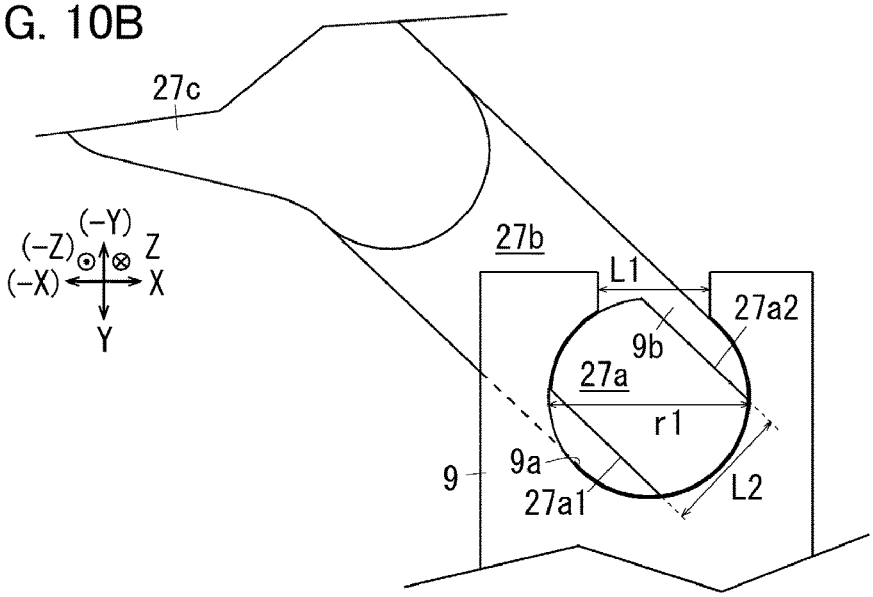
FIG. 10B is a section view taken along line XB-XB in FIG. 10A.

FIG. 10A is an enlarged perspective view of a belt offset sensing member and a shaft displacing member in Example 1, and illustrating a range from a front end portion of the driven roll to a front bearing, and FIG. 10B is a section view taken along line XB-XB in FIG. 10A.

Referring to FIGS. 3 to 6 and 9, the belt module BM has a pair of front and rear outer frames Fb which are an example of a second frame, and which are an example of a belt-like member support frame. The outer frame members Fb have a front belt support plate Fb1 which is an example of a front outer frame member, and a rear belt support plate Fb2 which is an example of a rear outer frame member. Referring to FIGS. 5, 9, and 10, the front belt support plate Fb1 and the rear belt support plate Fb2 are coupled with each other by an upper tie bar Fb3 which is an example of an upper coupling frame, and a lower tie bar Fb4 which is an example of a lower coupling frame. Referring to FIG. 10B, a groove portion 9 which is an example of a center mounting portion is formed in a front end portion of the lower tie bar Fb4 in Example 1. The groove portion 9 in Example 1 has an inner circumferential face 9*a* having a shape which covers the outer circumferential face of a column that vertically extends, and a cutout insertion portion 9*b* which is an opening formed on the left side of the inner circumferential face 9*a*. In Example 1, the opening width L1 of the cutout insertion portion 9*b* in the front and rear directions is previously set to be smaller than the inner diameter r1 which is the maximum width of the inner circumferential face 9*a* in the front and rear directions.

Referring to FIGS. 5 and 6, a driving shaft Rda which is rotated integrally with the driving roll Rd is rotatably supported through bearings Br, Br by upper end portions of the front and rear belt support plates Fb1, Fb2. A rotational force transmitting gear 11 is supported by a rear end portion of the driving shaft Rda, and a rotational force is transmitted from a medium conveying member driving source which is not shown.

Referring to FIGS. 5 and 6, long holes 12, 12 which are an example of a frame mounting portion that extend in the right and left directions are formed in lower portions of the front and rear belt support plates Fb1, Fb2.

In the front and rear belt support plates Fb1, Fb2, the driven roll Rj is rotatably supported below the long holes 12. In the driven roll Rj, a driven shaft Rja in which the axial direction extends in the front and rear directions coincident with the width direction of the medium conveying belt B, and which is an example of a rotation shaft is supported by a driven shaft supporting member 13 which is shown in FIG. 10A, and which is an example of a rotation shaft supporting member. The driven shaft supporting member 13 in Example 1 has a front bearing 13*a* which rotatably supports a front end portion that is an example of an end portion of the driven shaft Rja, and which is an example of a one-side supporting portion, and a rear bearing 13*b* which rotatably supports a rear end portion that is an example of another end portion of the driven shaft Rja, and which is an example of another side supporting portion.

Referring to FIGS. 3 to 5 and 9, recess grooves 14, 14 are formed in lower end portions of the front and rear belt support plates Fb1, Fb2. Referring to FIGS. 3 and 4, the recess grooves 14, 14 are rotatably supported by a frame support shaft 17 which is supported by the image forming apparatus main unit U1. The belt module BM can be swung about the frame support shaft 17 between a normal use position shown in FIG. 3, and a maintenance work position shown in FIG. 4.

Referring to FIG. 3, in a state where the belt module BM is moved to the normal use position, the bearings Br, Br which support the both end portions of the driving shaft Rda are contacted with positioning portions (not shown) disposed in the image forming apparatus main unit U1, thereby positioning the belt module BM.

Referring to FIG. 4, in the case where a maintenance work such as removal of sheet jamming or replacement of the visible image forming devices UY to UK is to be performed, the opening/closing portion U2 is opened, and the belt module BM is moved to the maintenance work position, whereby the interior is opened and the maintenance work is enabled.

Referring to FIGS. 5 and 6, a transfer frame Ft which is an example of a first frame, and which is an example of a transferring member support frame is placed inside the outer frame members Fb. The transfer frame Ft has a front transferring roll support frame Ft1 and rear transferring roll support frame Ft2 which are an example of a pair of front and rear transferring member supporting member. Front and rear end portions of the driving shaft Rda are rotatably passed through upper portions of the front and rear transferring roll support frames Ft1, Ft2. Namely, an upper portion of the transfer frame Ft is rotatably supported by the driving shaft Rda of the driving roll Rd.

Lower portions of the front and rear transferring roll support frames Ft1, Ft2 are coupled to each other by a plate coupling member Ft3 which is an example of a transferring member supporting member coupling member. Both end portions of the plate coupling member Ft3 are passed through the long holes 12, 12 of the front and rear belt support plates Fb1, Fb2 to be projected to the outside of the outer frame members Fb. Therefore, the plate coupling member Ft3 is supported movably along the long holes 12, 12.

A swing bracket SB which is an example of a movable frame is supported by a front end portion of the plate coupling member Ft3, so as to be swingable about the plate coupling member Ft3.

In Example 1, a through hole SB1 through which the plate coupling member Ft3 are passed to be supported is formed in an upper end portion of the swing bracket SB. A spring supporting groove SB2 which is a vertically extending groove, and which is an example of an elastic member supporting portion. A slider SB3 which is movable along the spring supporting groove SB2, and which is an example of a stretch movable member is supported by the swing bracket SB, and the front bearing 13*a* is supported by the slider SB3. A stretch spring SPa which is an example of an elastic member, and which is an example of a tension applying member is mounted between the slider SB3 and an upper end portion of the spring supporting groove SB2.

Therefore, the front bearing 13*a* is coupled to the plate coupling member Ft3 through the swing bracket SB, and, interlockingly with the swing bracket SB, supported rotatably about the plate coupling member Ft3.

The rear transferring roll support frame Ft2 is formed to be downward extended so as to be longer than the front transferring roll support frame Ft1. In Example 1, the lower end portion of the rear transferring roll support frame Ft2 has a spring supporting groove Ft2*a* similar to the spring supporting groove SB2, and a slider Ft2*b* which supports the rear bearing 13*b*, correspondingly with the slider SB3. Similarly with the swing bracket SB, a stretch spring SPa is mounted between the slider Ft2*b* and an upper end portion of the spring supporting groove Ft2*a*.

Therefore, the rear bearing 13*b* is supported so as to be vertically movable by the rear transferring roll support frame Ft2 through the slider Ft2*b*.

The bearings 13*a*, 13*b* are downward urged by the stretch springs SPa, Spa. Namely, the driven roll Rj is supported while being pressed in the downward direction which is an example of the downstream side in the stretching direction, so as to stretch the medium conveying belt B, and also functions as a stretching member which stretches over the medium conveying belt B.

A bracket press spring SPb which is an example of a tilt urging member is supported by the plate coupling member Ft3. One end of the spring is supported by the front transferring roll support frame Ft1, and the other end is supported by the swing bracket SB. Namely, the swing bracket SB in Example 1 is urged by the bracket press spring SPb toward a front end portion of the lower tie bar Fb4 which is placed on the right side. In Example 1, as a result, the front end portion of the driven shaft Rja of the driven roll Rj is preset so as to be tilted in the right direction with respect to the rear end portion.

The driving shaft Rda of the driving roll Rd in Example 1 is placed in parallel to the front and rear directions. In Example 1, therefore, the medium conveying belt B is preset so as to be offset in the front direction.

In the front and rear transferring roll support frames Ft1, Ft2, shaft position adjustment long holes Fty, Ftm, Ftc, Ftk which extend in the right and left directions are formed respectively correspondingly with the positions of the transferring rollers T1*y* to T1*k*. Referring to FIGS. 6A and 6B, in the front and rear transferring roll support frames Ft1, Ft2, pressing member supporting portions 19 which are projected toward the photosensitive members Py to Pk, i.e., from the inner side of the medium conveying belt B to the outside are formed between the shaft position adjustment long hole Ftm for magenta and the shaft position adjustment long hole Ftc for cyan. Referring to FIG. 6B, pressing member position adjustment long holes 19*a* which extend in the right and left directions are formed in the pressing member supporting portions 19. Belt pressing pins 20 which are an example of a pressing member are passed through the pressing member position adjustment long holes 19*a* so as to movable along the pressing member position adjustment long holes 19*a*.

Referring to FIG. 6A, pin pressing devices 21 which are supported by the front and rear transferring roll support frames Ft1, Ft2, and which are an example of a pressing member urging mechanism are supported on outer end portions of the belt pressing pins 20. Referring to FIG. 6C, the pin pressing devices 21 have bearing members 21*a* which rotatably support the outer end portions of the belt pressing pins 20. The bearing members 21*a* are always pressed toward the medium conveying belt B by one ends of elastic springs 21*b* which are an example of a pressing force generating member. The other end sides of the elastic springs 21*b* are supported by spring supporting containers 21*c*.

As shown in FIG. 5, the pair of front and rear belt pressing pins 20 in Example 1 are placed outside of a cleaning region L1 where the surface of the medium conveying belt B is cleaned by the belt cleaner CLb. In Example 1, the cleaning region L1 is set to be wider than the maximum width of the useful recording sheet S, and the maximum width of image forming regions which are regions of images formed on the photosensitive members Py to Pk is set to be narrower than the maximum width of the recording sheet S.

Referring to FIGS. 5, 6A, and 7, the shafts 22*y*, 22*m*, 22*c*, 22*k* of the transferring rolls T1*y*, T1*m*, T1*c*, T1*k* are supported so as to be movable by a predetermined distance in the right and left directions along the shaft position adjustment long holes Fty, Ftm, Ftc, Ftk. The shafts 22*y* to 22*k* of the transferring rolls T1*y* to T1*k* are supported by shaft urging mechanisms which are configured in a similar manner as the pin pressing devices 21, and which are not shown. Referring to FIGS. 7 and 8, namely, the transferring rolls T1*y* to T1*k* are urged by transferring shaft urging springs 23*y*, 23*m*, 23*c*, 23*k* corresponding to the elastic springs 21*b* so that the medium conveying belt B is pressed toward the outer surface side, i.e., the photosensitive members Py to Pk as diagrammatically shown.

In Example 1, the pressing forces exerted by the transferring shaft urging springs 23*y* to 23*k* are set to be larger than those exerted by the elastic springs 21*b*. The force by which the medium conveying belt B is pressed by the elastic springs 21*b* is preset to a level which is slightly larger than the tension of the medium conveying belt B, and at which the belt pressing pins 20 are contacted with the medium conveying belt B and do not substantially deform the shape of the medium conveying belt B.

Referring to FIGS. 7 and 8, a transfer frame pressing spring SPc which exerts a force of always pressing the plate coupling member Ft3 toward the photosensitive members Py to Pk, and which is an example of a supporting member urging member is placed between the plate coupling member Ft3 and the lower end portion of the outer frame members Fb. In the plate coupling member Ft3, an eccentric cam HC which is supported by the image forming apparatus main unit U1, and which is an example of a belt-like member contacting/separating member is placed to be opposed to the transfer frame pressing spring SPc.

When the eccentric cam HC is moved to a belt-like member contacting position shown in FIG. 7, therefore, the transfer frame Ft is pressed toward the photosensitive members Py to Pk by the transfer frame pressing spring SPc, and the medium conveying belt B is contacted with all of the photosensitive members Py to Pk. In this state, therefore, a multi-color image is formed and transferred. When the eccentric cam HC is moved to a belt-like member separating position shown in FIG. 8, the transfer frame Ft is swung and moved against the elastic force of the transfer frame pressing spring SPc, and the medium conveying belt B is separated from the photosensitive members Py, Pm, Pc other than the photosensitive member for black. In this state, therefore, a monochromatic image is formed and transferred. In Example 1, namely, the photosensitive member Pk for black is always contacted with the medium conveying belt B, and the photosensitive members Py, Pm, Pc for the other colors are contacted with or separated from the medium conveying belt B.

Referring to FIG. 9, a recovering device KS incorporating the belt cleaner CLb which, when the recording sheet S is conveyed, removes paper dusts, developers, and the like adhering to the medium conveying belt B is supported on the right side of the outer frame members Fb. In the recovering device KS, a gripping portion KSa is formed which is gripped by the user when the belt module BM is swung from the normal use position shown in FIG. 3 to the maintenance work position shown in FIG. 4.

Description of Belt Offset Sensing Member 26 and Shaft Displacing Member 27 in Example 1

Referring to FIG. 10, a disk-like belt offset sensing member 26 which is an example of an interlocking member contacted with the front edge that is an example of the width-direction edge of the medium conveying belt B, and which is an example of a movement sensing member is supported by a front end portion of the driven shaft Rja so as to be movable along the front and rear directions coincident with the axial direction. A shaft displacing member 27 which causes the rotation shaft to be tilted to the left direction that is an example of a tilting direction is placed between the belt offset sensing member 26 and the front bearing 13*a*. The interlocking member is contacted with a part of the end face of the endless belt-like member to be moved, thereby sensing the width-direction position of the endless belt-like member.

Figure 11A:
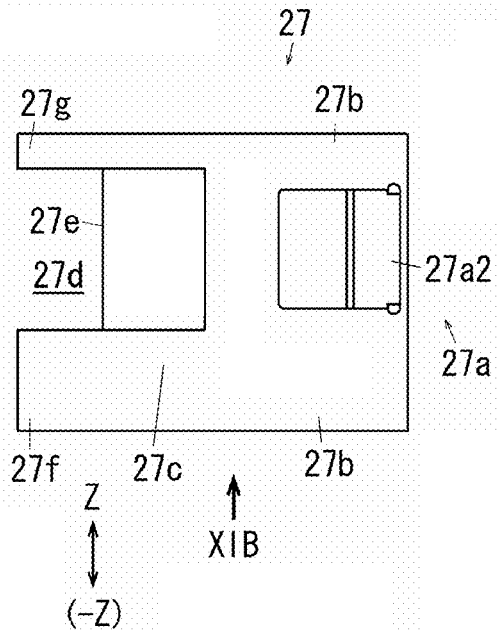
FIGS. 11A to 11D are enlarged views illustrating the shaft displacing member in Example 1.
Figure 11B:
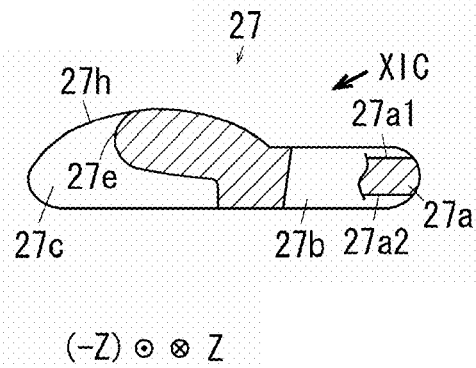
Figure 11C:
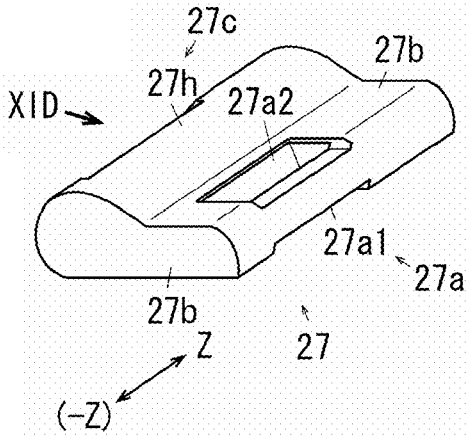
Figure 11D:
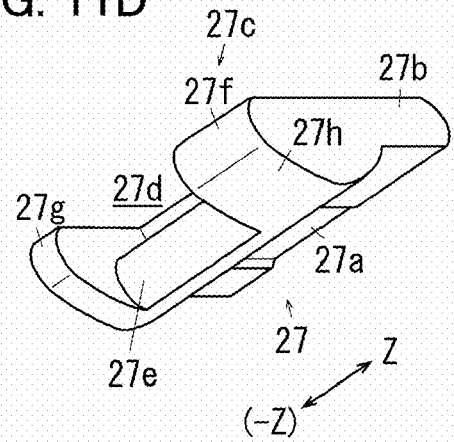

FIGS. 11A to 11D are enlarged views illustrating the shaft displacing member in Example 1, FIG. 11A is an enlarged view as seen in the direction of arrow XIA in FIG. 10A, FIG. 11B is an enlarged view as seen in the direction of arrow XIB in FIG. 11A, FIG. 11C is an enlarged view as seen in the direction of arrow XIC in FIG. 11B, and FIG. 11D is an enlarged perspective view as seen in the direction of arrow XID in FIG. 11C.

Referring to FIGS. 10A, 10B and 11A to 11D, the shaft displacing member 27 in Example 1 has a swing center 27*a* which is placed on the right of the driven shaft Rja, and which extends along the upper and lower directions that are an example of an intersecting direction intersecting with the driven shaft Rja.

Referring to FIGS. 10B and 11A to 11D, the swing center 27*a* in Example 1 is formed into a shape in which the both sides of the outer surface of a column in the front and rear directions are partly cut away, and has cutout faces 27*a*1, 27*a*2. Namely, as shown in FIG. 10B, the swing center 27*a* is formed to have a shape in which the outer surface of a column is partly cutout, and a section of a shape in which right and left end portions of a circle are cutout, or a so-called double D-cut shape. In Example 1, the diameter of the column is preset to be equal to the inner diameter r1 of the inner circumferential face 9*a* of the groove portion 9. In Example 1, the cutout distance L2 which is the distance between the cutout faces 27*a*1, 27*a*2 is preset to be shorter than the opening width L1 of the cutout insertion portion 9*b* of the groove portion 9.

As shown in FIG. 10B, therefore, the swing center 27*a* can be inserted into the cutout insertion portion 9*b* from the left side of the groove portion 9 of the lower tie bar Fb4 in a state where the posture of the shaft displacing member 27 is set so that the cutout distance L2 is within the opening width L1. In the inserted state, the swing center is rotatably supported by the inner circumferential face 9*a*. Namely, the swing center 27*a* is supported rotatably and detachably with respect to the groove portion 9.

Columnar extension portions 27*b*, 27*b* which extend in parallel to the cutout faces 27*a*1, 27*a*2 are formed on the both end portions of the swing center 27*a* in the upper and lower directions coincident with the center axis direction. Semi-circular contacting portions 27*c* having a D-like section shape which vertically extends are formed on end portions of the extension portions 27*b*, 27*b* which are opposite to the swing center 27*a*. In the contacting portions 27*c* in Example 1, a recess 27*d* which is configured by an opening that is recessedly cut is formed in the vertical middle of opposite outer end portions of the extension portions 27*b*, 27*b*. In the recess 27*d* in Example 1, a shaft contacting face 27*e* which is configured by a convex curved body that vertically extends, which is to be contacted with the driven shaft Rja, and which is an example of a rotation shaft contacting portion is formed.

Upper and lower contacting portions 27*f*, 27*g* which are bifurcated across the recess 27*d*, and which are examples of upstream and downstream contacting portions are formed on the sides of the upper and lower ends of the recess 27*d*. The left end faces 27*h* which are contacting faces of the contacting portions 27*f*, 27*g* are contacted with the belt offset sensing member 26 on the vertical sides across the driven shaft Rja.

The upper and lower contacting portions 27*f*, 27*g* constitute the interlocking member contacting portion (27*f*+27*g*) in Example 1.

Figure 12:
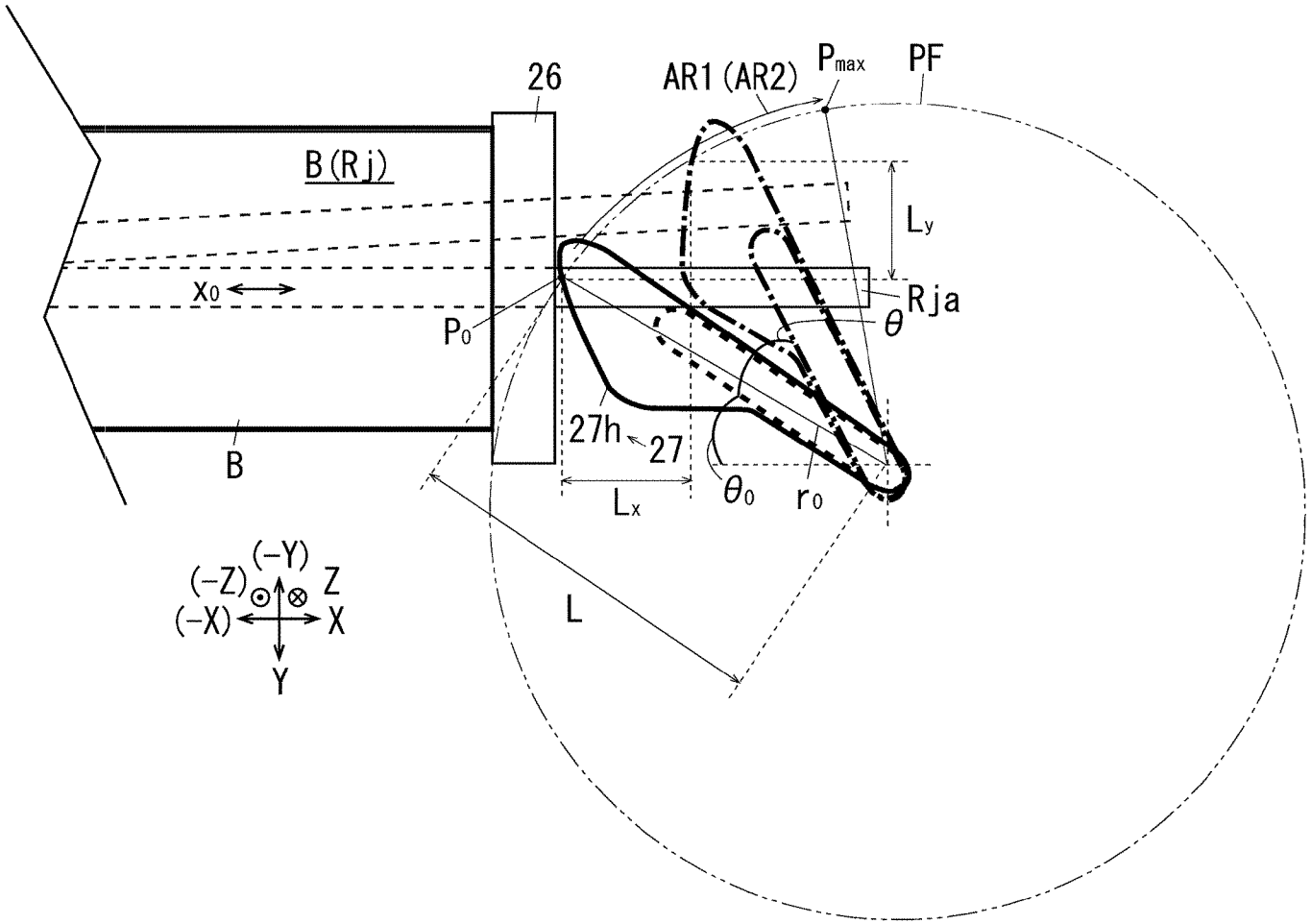
FIG. 12 is a section view taken along line XII-XII in FIG. 10A, and showing relationships between forward movement of the medium conveying belt and leftward movement of a driven shaft due to the shaft displacing member.

FIG. 12 is a section view taken along line XII-XII in FIG. 10A, and showing relationships between forward movement of the medium conveying belt and leftward movement of the driven shaft due to the shaft displacing member.

Referring to FIG. 12, the left end faces 27*h* of the interlocking member contacting portion (27*f*+27*g*) in Example 1 are formed so that the radius of curvature is more increased as advancing from the outer end side of the recess 27*d* toward the extension portions 27*b*, 27*b*. Specifically, the left end faces are preset so that the members B, 26 are moved in the front direction which is the width direction, and the history of the contact points between the belt offset sensing member 26 and the left end faces 27*h*, or a so-called contact profile PF is arcuate.

The outer frame members Fb, the transfer frame Ft, the transfer frame pressing spring SPc, the eccentric cam HC, and the like constitute a belt moving mechanism Fb+Ft+SPc+Hc which is an example of a belt-like member moving mechanism in Example 1. The outer frame members Fb, the belt supporting roll Rd+Rj, the medium conveying belt B, the transfer frame Ft, the transferring rolls T1*y* to T1*k*, the recovering device KS, the belt offset sensing member 26, the shaft displacing member 27, and the like constitute the belt module BM in Example 1.

Function of Example 1

In the thus configured printer U which is an example of the image forming apparatus of Example 1, when an image forming operation, or a so-called job is started, the recording sheet S is held on the surface of the medium conveying belt B, images are transferred to the recording sheet S when the recording sheet is passed through the transferring regions Q3*y* to Q3*k*, and the images are fixed in the fixing region Q5 of the fixing device F.

When the medium conveying belt B meanders, a problem occurs in the conveyance of the recording sheet S. In Example 1, as shown in FIG. 10A, the front end portion of the driven shaft Rja of the driven roll Rj is urged toward the right side or the lower tie bar Fb4 through the members SPb, SB, 13*a*. Namely, the front end portion of the driven shaft Rja is tilted in the right direction with respect to the rear end portion, and tilted with respect to the driving shaft Rda of the driving roll Rd which extends in the front and rear directions. As shown in FIG. 12, in the case where the medium conveying belt B is offset, therefore, offset toward the front direction is set. When the medium conveying belt B is offset in the front direction, the front end of the medium conveying belt B is contacted with the belt offset sensing member 26, and the medium conveying belt B and the belt offset sensing member 26 are interlockingly moved in the front direction.

Therefore, the interlocking member contacting portion (27*f*+27*g*) with which the belt offset sensing member 26 is contacted is forward pressed, and the pressed interlocking member contacting portion (27*f*+27*g*) of the shaft displacing member 27 is swung about the swing center 27*a*. In this case, the shaft contacting face 27*e* of the shaft displacing member 27 is swung integrally with the interlocking member contacting portion (27*f*+27*g*) to press the driven shaft Rja in the left direction.

Therefore, the medium conveying belt B is moved in the rear direction, the front end of the driven shaft Rja approaches being parallel to the rear end, or is tilted in the rear direction, so that the medium conveying belt B is held at the balanced position where the offset of the medium conveying belt B stops and the belt balances. Therefore, offset of the medium conveying belt B is restricted, and offset of the medium conveying belt B is eliminated. In the printer U of Example 1, in accordance with movements of the members B, 26 in the front direction, the shaft displacing member 27 is swung on the XY plane including the X direction as the front and rear directions, and the Y direction as the right and left directions, and the driven shaft Rja is moved in the left direction.

In the printer U of Example 1, in accordance with offset of the members B, 26, the shaft displacing member 27 is swung about the swing center 27*a* to tilt the driven shaft Rja. The structure for correcting meandering of the medium conveying belt B is simplified as compared with the technique in which the pressing force of the belt offset sensing member is measured and the driven shaft is tilted, and the technique in which the rotation torque of the medium conveying belt is given to the belt offset sensing member and the string member is wound, thereby tilting the driven shaft.

In the printer U of Example 1, the locus of rotation of the shaft displacing member 27 exhibits a two-dimensional circular shape. Therefore, the structure for correcting meandering of the medium conveying belt B is simplified as compared with the technique in which the locus of rotation of the shaft displacing member exhibits a three-dimensional bevel shape.

In the printer U of Example 1, the radius of curvature of the left end faces 27*h* is set so that the contact profile PF shown in FIG. 12 is arcuate. In Example 1, as shown in FIG. 12, the line segment of the shaft displacing member 27 connecting from the swing center 27*a* to the interlocking member contacting position where the interlocking member contacting portion (27*f*+27*g*) and the belt offset sensing member 26 are contacted with each other is indicated by a shaft displacement line segment $r_0$, the line in the width direction of the medium conveying belt B before the medium conveying belt B is moved, i.e., the line corresponding to the driven shaft Rja which is tilted with respect to the driving shaft Rda is indicated by a width direction line $x_0$, the length of the shaft displacement line segment $r_0$ is indicated by L [mm], the angle formed by the shaft displacement line segment $r_0$ and the width direction line $x_0$ is indicated by $\theta_0$ [rad], the moving distance of offset of the members B, 26 in the front direction is indicated by Lx [mm], an increment of the angle $\theta_0$ after the members B, 26 are moved is indicated by $\theta$ [rad], and the moving distance in the left direction of the front end portion of the driven shaft Rja due to the shaft displacing member 27 is indicated by Ly [mm]. In this case, the relationships between the rotation angles $\theta_0$, $\theta$ of the shaft displacing member 27 and the moving distances Lx, Ly are preset so that following Expressions (1-1) and (1-2) hold.

$$Lx=L(\cos(\theta_0)-\cos(\theta_0+\theta)) \quad (1\text{-}1)$$

$$Ly=L(\sin(\theta_0+\theta)-\sin(\theta_0)) \quad (1\text{-}2)$$

In the printer U of Example 1, therefore, the relationships between the moving distances Lx, Ly can be adjusted on the basis of trigonometric functions of the angles $\theta_0$, $\theta$ of the shaft displacing member 27 as shown in Expressions (1-1) and (1-2) above.

In the printer U of Example 1, as compared with the case where the moving distances Lx, Ly cannot be adjusted on the basis of Expressions (1-1) and (1-2) above, consequently, the moving distance Lx [mm] of the members B, 26 can be efficiently converted to the moving distance Ly [mm] of the driven shaft Rja by swing of the shaft displacing member 27.

In the printer U of Example 1, the relationships between the moving distance Lx [mm] of the members B, 26 and the moving distance Ly [mm] of the driven shaft Rja can be adjusted on the basis of the radius of curvature of the left end faces 27*h* which are contact faces with respect to the belt offset sensing member 26.

In the printer U of Example 1, as compared with the case where the moving distances Lx, Ly cannot be adjusted on the basis of Expressions (1-1) and (1-2) above, the movement of the members B, 26, and the swing of the shaft displacing member 27 can be smoothly interlocked with each other. In the printer U of Example 1, even when the balanced position in the case where the multi-color image forming operation shown in FIG. 7, or a so-called full-color mode is performed is changed from that in the case where the monochromatic image forming operation shown in FIG. 8, or a so-called monochromatic mode is performed, therefore, the movement of the driven shaft Rja due to the shaft displacing member 27 is rapidly converged, and meandering of the medium conveying belt B can be rapidly corrected. In the case where normal sheets and thick sheets are to be conveyed, even when the balanced position is changed depending on the kinds of the medium, for example, the movement of the driven shaft Rja due to the shaft displacing member 27 is rapidly converged, and meandering of the medium conveying belt B can be rapidly corrected.

In the printer U of Example 1, as compared with the configuration where the radius of curvature of the left end faces 27*h* is not smoothly continuously changed, the noise level when meandering of the medium conveying belt B is corrected is lowered.

The printer U of Example 1 is configured so that the driven shaft Rja which is formed into a columnar shape extending in the front and rear directions, and the shaft contacting face 27*e* configured by a convex curved body which extends in the upper and lower directions make a point contact with each other. In the printer U of Example 1, as compared with the configuration where the driven shaft Rja and the shaft contacting face 27*e* do not make a point contact with each other, therefore, the noise level when meandering of the medium conveying belt B is corrected is lowered, and wear between the driven shaft Rja and the shaft contacting face 27*e* is reduced, so that the maintenance cost of the shaft displacing member 27 can be reduced.

In the thus configured printer U of Example 1, as shown in FIG. 6A, the bearings 13*a*, 13*b* of the driven shaft Rja are supported by the slider SB3 of the swing bracket SB, and the slider Ft2*b* in the lower end portion of the rear transferring roll support frame Ft2. As shown in FIG. 10B, the swing center 27*a* of the shaft displacing member 27 is rotatably supported by the inner circumferential face 9*a* of the groove portion 9 of the lower tie bar Fb4. In the printer U of Example 1, namely, the driven shaft Rja is supported by the transfer frame Ft which is an example of the first frame, and the shaft displacing member 27 is supported by the outer frame members Fb which are an example of the second frame.

As a result, in the printer U of Example 1, as compared with the configuration where the driven shaft Rja and the shaft displacing member 27 are supported by the same frame, the shaft displacing member 27 can be easily mounted on the belt module BM. In the printer U of Example 1, as compared with the configuration where the driven shaft Rja and the shaft displacing member 27 are supported by the same frame, particularly, a wide region such as a space where the portions 27*a* to 27*e* of the shaft displacing member 27 can be placed can be ensured, and the degree of freedom of placement of the swing center 27*a* can be enhanced.

In the thus configured printer U of Example 1, as shown in FIG. 10B, the swing center 27*a* of the shaft displacing member 27 is formed by the cutout faces 27*a*1, 27*a*2 so as to have a double D-cut shape section. Therefore, the swing center 27*a* can be inserted into the cutout insertion portion 9*b* from the left side of the groove portion 9 in a state where the posture of the shaft displacing member 27 is set so as to be fitted into the cutout insertion portion 9*b* of the groove portion 9. At this time, as shown in FIG. 12, the printer U of Example 1 is set so that the interlocking member contacting portion (27*f*+27*g*) is moved in a movement range AR1 of the interlocking member contacting portion (27*f*+27*g*) which extends between a pre-movement contacting portion contact position $P_0$ where, before the medium conveying belt B is forward offset, the interlocking member contacting portion (27*f*+27*g*) is contacted with the belt offset sensing member 26, and a maximum post-movement contacting portion contact position $P_{max}$ where, after the medium conveying belt B is forward offset at the maximum degree, the interlocking member contacting portion (27*f*+27*g*) is contacted with the belt offset sensing member 26.

The cutout insertion portion 9*b* is formed on the left side or outside of a swing range AR2 of the swing center 27*a* corresponding to the movement range AR1. In the printer U of Example 1, during swing of the swing center 27*a* in which the shaft displacing member 27 swings in the swing range AR2, therefore, the swing center 27*a* is prevented from dropping off from the inner circumferential face 9*a*. In the printer U of Example 1, as compared with the case where the cutout insertion portion 9*b* is placed in the swing range AR2, and a drop-off preventing member for the swing center 27*a* closing the opening of the cutout insertion portion 9*b* is used, the swing center 27*a* can be easily mounted, and the number of components of the supporting member for supporting the swing center 27*a* can be reduced.

In the thus configured printer U of Example 1, the medium conveying belt B extends in the upper and lower directions coincident with the stretching direction of the stretching rolls Rd, Rj. As shown in FIG. 10A, the upper and lower contacting portions 27*f*, 27*g* of the shaft displacing member 27 are placed across the driven shaft Rja which is contacted with the shaft contacting face 27*e* in the recess 27*d* of the shaft displacing member 27.

In the printer U of Example 1, as shown in FIG. 10A, the driven shaft Rja is set so as to intersect with a contact line segment Ls which is a line segment connecting an upper contacting portion contact position $P_1$ where the left end face 27*h* of the upper contacting portion 27*f* is contacted with the belt offset sensing member 26, with a lower contacting portion contact position $P_2$ where the left end face 27*h* of the lower contacting portion 27*g* is contacted with the belt offset sensing member 26. Namely, the interlocking member contacting portion (27*f*+27*g*) in Example 1 is set so as to be contacted with the lateral middle portions of the belt offset sensing member 26 across the driven shaft Rja.

In the printer U of Example 1, a winding angle that is an angle by which the medium conveying belt B is wound around the driven roll Rj is set to be about 180°. Therefore, Example 1 is set so that, when the medium conveying belt B is forward offset, the front end edge of the medium conveying belt B presses right, lower, and left end portions of the belt offset sensing member 26 in a U-like manner.

Therefore, the interlocking member contacting portion (27*f*+27*g*) in Example 1 is contacted with two places across the driven shaft Rja, or the lateral middle portions which are the middles of the right and left end portions of the belt offset sensing member 26 that are pressed by the medium conveying belt B. In an assumed case where the interlocking member contacting portion (27*f*+27*g*) is contacted with only one place of the belt offset sensing member 26, for example, only the upper contacting portion contact position $P_1$, consequently, there is the possibility that the belt offset sensing member 26 pressed by the medium conveying belt B is swung and tilted while using the upper contacting portion contact position $P_1$ as a fulcrum. In this case, the tilted belt offset sensing member 26 is hardly moved in the axial direction, and there is the possibility that offset of the medium conveying belt B is hardly interlocked with the belt offset sensing member 26. Therefore, correction of offset may be delayed, or the accuracy may be impaired.

By contrast, in the printer U of Example 1, the contact position of the interlocking member contacting portion (27*f*+27*g*) is placed in two places across the driven shaft Rja. AS compared with the case where the contact position of the interlocking member contacting portion (27*f*+27*g*) is placed in one place, therefore, offset of the medium conveying belt B can be efficiently transmitted to interlocking of the belt offset sensing member 26, and swing of the shaft displacing member 27.

When the winding angle is smaller than 180°, the range where the medium conveying belt B is contacted with the belt offset sensing member 26 tends to be concentrated to one portion, and the belt offset sensing member 26 is easily tilted. When, as in the interlocking member contacting portion (27*f*+27*g*) in Example 1, the contact is made in two places across the driven shaft Rja, the effect of reducing the tilting of the belt offset sensing member 26 is increased. Therefore, the belt offset sensing member 26 is easily interlocked with offset of the medium conveying belt B, and the responsibility of the offset correction by the shaft displacing member 27 is improved.

In the printer U of Example 1, the winding angle that is an angle by which the medium conveying belt B is wound around the driven roll Rj is set to be about 180°. Therefore, Example 1 is set so that, when the medium conveying belt B is forward offset, the front end edge of the medium conveying belt B presses right, lower, and left end portions of the belt offset sensing member 26 in a U-like manner.

As a result, in the printer U of Example 1, as compared with the case where the winding angle is smaller than 180°, the range where the belt offset sensing member 26 is contacted with the front edge of the medium conveying belt B is widened, and the member is easily moved in the front direction in an interlocking manner. Namely, the belt offset sensing member 26 can easily sense forward offset of the medium conveying belt B. In the printer U of Example 1, as compared with the case where the winding angle is smaller than 180°, therefore, offset of the medium conveying belt B can be efficiently transmitted to interlocking of the belt offset sensing member 26, and swing of the shaft displacing member 27.

In the printer U of Example 1, therefore, the belt offset sensing member 26 can be efficiently and smoothly moved interlockingly with offset of the medium conveying belt B. Even in the case where the rigidity of the medium conveying belt B is low, consequently, meandering of the medium conveying belt B can be corrected without causing wrinkles in the front edge of the medium conveying belt B which is contacted with the belt offset sensing member 26. As a result, in the printer U of Example 1, the production cost of the medium conveying belt B can be reduced.

Example 2

Next, Example 2 of the invention will be described. In the description of Example 2, components corresponding to those of Example 1 described above are denoted by the same reference numerals, and their detailed description is omitted.

Example 2 is different from Example 1 in the following points, but configured in a similar manner as Example 1 in the other points.

Description of Belt Module BM in Example 2

Figure 13B:
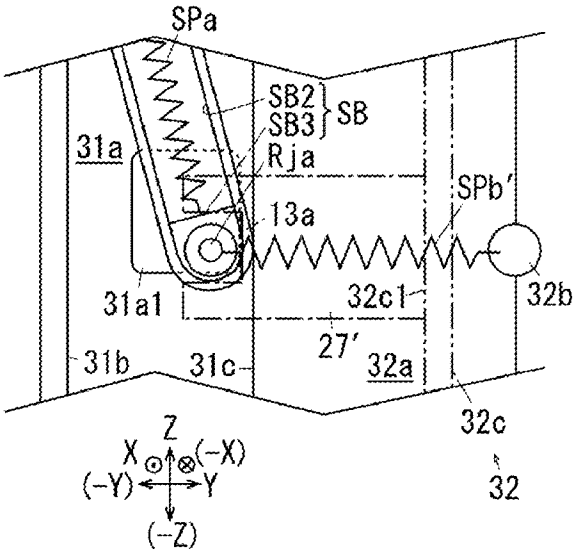
FIGS. 13A and 13B are views illustrating a belt offset sensing member and a shaft displacing member in Example 2 of the invention.
Figure 13A:
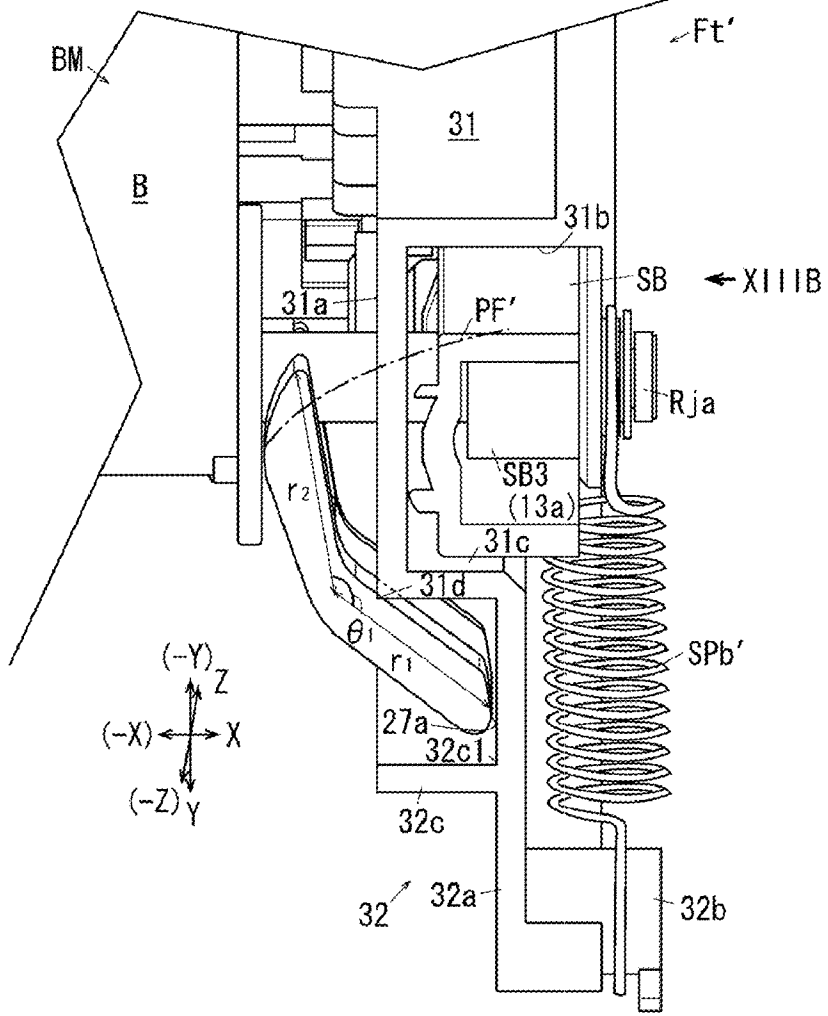

FIGS. 13A and 13B are views illustrating a belt offset sensing member and a shaft displacing member in Example 2 of the invention, FIG. 13A is a sectional perspective view corresponding to FIG. 10A in Example 1, and illustrating a range from a front end portion of a driven roll to a front bearing, and FIG. 13B is a diagram of a swing bracket as seen in the direction of arrow XIIIB in FIG. 13A.

Referring to FIG. 13A, the printer U of Example 2 has a transfer frame Ft' which is an example of a shaft support frame, and which is an example of a transferring member support frame, in place of the transfer frame Ft of the belt module BM in Example 1.

Referring to FIG. 13B, in the transfer frame Ft' in Example 2, a swing restricting portion 31 which has a shape where the outer surface of the front transferring roll support frame Ft1 is inwardly recessed, and which is an example of a movable restricting portion is formed in a lower end portion of the front transferring roll support frame Ft1. The swing bracket SB is housed in the swing restricting portion 31 in Example 2. The swing restricting portion 31 in Example 2 has a plate-like rear end wall 31*a* which is placed in rear of the swing bracket SB, and which perpendicularly intersects with the driven shaft Rja. In the rear end wall 31*a* in Example 2, a shaft guiding long hole 31*a*1 through which the driven shaft Rja is passed, and which can guide the shaft in the upper and lower, and right and left directions is formed at a position corresponding to the driven shaft Rja.

In the swing restricting portion 31, plate-like left and right end walls 31*b*, 31*c* which forward extend from the left and right ends of the rear end wall 31*a*. A corner portion 31*d* formed by the rear end wall 31*a* and the right end wall 31*c* constitutes the swing restricting portion 31 in Example 2. On the side of the right end wall 31*c* in the right direction which is an example of a perpendicular direction, a center supporting recess 32 having a recessed shape which is formed by outward recessing the inner surface of the front transferring roll support frame Ft1 is formed.

A plate-like front end wall 32*a* which rightward extends from the front end of the right end wall 31*c* is formed in the center supporting recess 32 in Example 2. A projection 32*b* which is forward projected is formed in a right end portion of the outer surface of the front end wall 32*a* in Example 2. In Example 2, in place of the bracket press spring SPb in Example 1, a driven-shaft press spring SPb' which is an example of a tilt urging member is connected between the projection 32*b* and the driven shaft Rja.

In Example 2, therefore, the swing bracket SB is urged toward the right end wall 31*c* through the driven shaft Rja and the front bearing 13*a*, by the driven-shaft press spring SPb'. As a result, in Example 2, similarly with Example 1, the front end portion of the driven shaft Rja is preset so as to be tilted in the right direction with respect to the rear end portion.

In Example 2, similarly with Example 1, the driving shaft Rda of the driving roll Rd is placed in parallel to the front and rear directions, and, therefore, the medium conveying belt B is preset so as to be offset in the front direction.

Description of Shaft Displacing Member 27' in Example 2

An inner wall 32*c* which extends in the upper and lower directions is formed in a middle portion in the right and left directions of the inner surface of the front end wall 32*a*. In Example 2, in place of the groove portion 9 of the lower tie bar Fb4 in Example 1, a center supporting portion 32*c*1 which is a corner portion formed by the front end wall 32*a* and a left end portion of the inner wall 32*c* is formed. In Example 2, in place of the shaft displacing member 27 in Example 1, a shaft displacing member 27' is supported by the center supporting portion 32*c*1. Namely, the shaft displacing member 27' in Example 2 is swingably supported in a state where the position of the swing center 27*a* in the front and rear directions partly overlaps that of the front bearing 13*a* in the front and rear directions.

In the shaft displacing member 27 in Example 1, the shaft displacement line segment $r_0$ shown in FIG. 12 linearly extends in the extending direction of the extension portions 27*b*, 27*b* from the swing center 27*a* to the outer end portion of the contacting portions 27*c*. By contrast, in the shaft displacing member 27' in Example 2, as shown in FIG. 13A, a line segment $r_2$ connecting a connecting position with the extension portions 27*b*, 27*b* of the contacting portions 27*c* with the outer end end portion is set to be tilted forward by an angle $\theta_1$ with respect to a first shaft displacement line segment $r_1$ connecting the swing center 27*a* with the extension portions 27*b*, 27*b*. Namely, the shaft displacing member 27' in Example 2 is formed to be more forward curved as further advancing from the swing center 27*a* toward the outer end portion of the contacting portions 27*c*.

As indicated by the alternate long and short dash line in FIG. 13A, Example 2 is preset so that, because of the radius of curvature of the left end faces 27*h*, the contact profile PF' which is the history of the contact point between the belt offset sensing member 26 and the left end faces 27*h* due to the axial movement of the belt offset sensing member 26 exhibits an involute curve shape which extends toward the center of the arc, in contrast to the arcuate contact profile PF in Example 1. The involute curve is a curve which, when a string is wound around a stationary shaft and the string is rewound while pulling the tip end of the string, is drawn by the tip end of the string.

Function of Example 2

In the thus configured printer U which is an example of the image forming apparatus of Example 2, as shown in FIGS. 13A and 13B, the center supporting portion 32*c*1 of the center supporting recess 32 which supports the swing center 27*a* of the shaft displacing member 27' is placed in the front end portion of the swing restricting portion 31. Namely, the position of the swing center 27*a* in the axial direction coincident with the front and rear directions partly overlaps that in the axial direction of the front bearing 13*a* of the driven shaft Rja housed in the swing restricting portion 31. In the printer U of Example 2, as compared with the case where the swing center 27*a* is placed axially inside of the front bearing 13*a*, therefore, the contacting portions 27*c* of the shaft displacing member 27' can be placed axially outside of the driven shaft Rja. In the printer U of Example 2, as compared with the case where the swing center 27*a* is not overlappingly placed with respect to the axial position of the front bearing 13*a*, the width of the driven shaft Rja which is required for placing the shaft displacing member 27' can be reduced.

As a result, in the printer U of Example 2, the whole length of the driven shaft Rja can be shortened, and the whole belt module BM and the whole printer U can be miniaturized.

In the case where the front end portion of the driven shaft Rja is lifted while using the rear bearing 13*b* of the driven shaft Rja as a fulcrum, the front end portion can be lifted because of the principle of leverage by a smaller force when a position which is remote from the rear bearing 13*b* as far as possible, i.e., a position which is close to the front bearing 13*a* as far as possible is used as a force application point. Namely, when the shaft contacting face 27*e* of the shaft displacing member 27 which functions as the force application point is placed at a position which is close to the front bearing 13*a*, the front end portion can be lifted by a smaller force.

In Example 2, the swing center 27*a* is placed overlappingly with the axial position of the front bearing 13*a*, and the shaft contacting face 27*e* is placed axially outside of the driven shaft Rja as far as possible. In the printer U of Example 2, as compared with the case where the swing center 27*a* is not overlappingly placed with respect to the axial position of the front bearing 13*a*, therefore, the shaft contacting face 27*e* can be placed at a position which is close to the front bearing 13*a*, and the driven shaft Rja can be tilted by a small force.

As shown in FIG. 13A, the shaft displacing member 27' in Example 2 is formed to be more forward curved as further advancing from the swing center 27*a* toward the outer end portion of the contacting portions 27*c*. In the printer U of Example 2, as compared with the case where, as in the shaft displacing member 27 in Example 1, the range from the swing center 27*a* to the outer end portion of the contacting portions 27*c* is linearly formed, the width of the driven shaft Rja which is required for placing the shaft displacing member 27' can be further reduced. As a result, in the printer U of Example 2, the whole length of the driven shaft Rja can be shortened, and further miniaturization of the whole belt module BM and the whole printer U are enabled.

In the printer U of Example 2, as compared with the case where the range from the swing center 27*a* to the outer end portion of the contacting portions 27*c* is linearly formed, the shaft contacting face 27*e* is placed at a position which is close to the front bearing 13*a*, the driven shaft Rja can be lifted by a further small force.

In Example 2, the radius of curvature of the left end faces 27*h* becomes larger as further advancing from the outer end side of the recess 27*d* toward the extension portions 27*b*, 27*b*, and is set so that the contact profile PF' shown in FIG. 13A exhibits an involute curve shape. Namely, the shaft displacing member 27' in Example 2 is set so that, as advancing toward the axial outside in accordance with the movement in the front direction coincident with the axial direction of the belt offset sensing member 26, the movement in the left direction coincident with the inclination direction of the contacts between the belt offset sensing member 26 and the left end faces 27*h* is further reduced.

Therefore, Example 2 is set so that, in the case where the medium conveying belt B is offset, as the front end portion of the driven shaft Rja is further moved in the left direction in which offset is corrected, to approach the balanced position where offset of the medium conveying belt B stops, the moving distance of the driven shaft Rja is more reduced. As a result, in the printer U of Example 2, as compared with the case where the radius of curvature of the left end faces 27*h* is not set so that the contact profile PF' exhibits an involute curve, offset of the medium conveying belt B is easily converged in the vicinity of the balanced position.

In the thus configured printer U of Example 2, the corner portion 31*d* formed by the rear end wall 31*a* of the swing restricting portion 31 and the right end wall 31*c* is placed on the left side of the shaft displacing member 27'. In the case where, when offset of the medium conveying belt B is corrected in the front direction, the shaft displacing member 27' is swung, therefore, the swing of the shaft displacing member 27' is restricted at the maximum swing position where the shaft displacing member 27' is contacted with the corner portion 31*d*.

In the printer U of Example 2, therefore, the swing range of the shaft displacing member 27' can be restricted by the corner portion 31*d*. When offset of the medium conveying belt B is corrected, for example, the shaft displacing member 27' can be prevented from being swung to a non-functional region where the shaft displacing member 27' exceeds the so-called top dead point and cannot return with following returning of the medium conveying belt B and the driven shaft Rja.

In the printer U of Example 2, the maximum swing position can be set at an arbitrary position by adjusting the position of the corner portion 31*d*, and the shaft displacing member 27' can be restricted from being excessively swung.

In other points, the printer U of Example 2 can attain the same effects as the printer U of Example 1.

Example 3

Next, Example 3 of the invention will be described. In the description of Example 3, components corresponding to those of Example 2 described above are denoted by the same reference numerals, and their detailed description is omitted.

Example 3 is different from Example 2 in the following points, but configured in a similar manner as Example 2 in the other points.

Description of Belt Module BM in Example 3

Figure 14A:
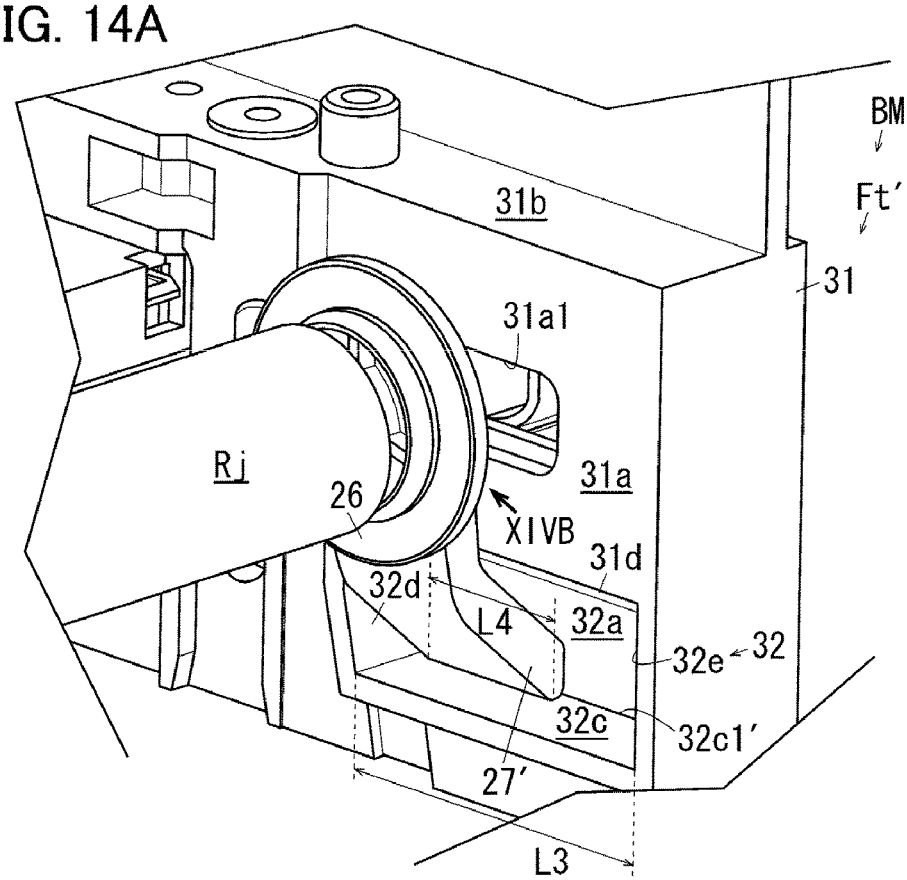
FIGS. 14A and 14B are views illustrating a belt offset sensing member and a shaft displacing member in Example 3 of the invention.
Figure 14B:
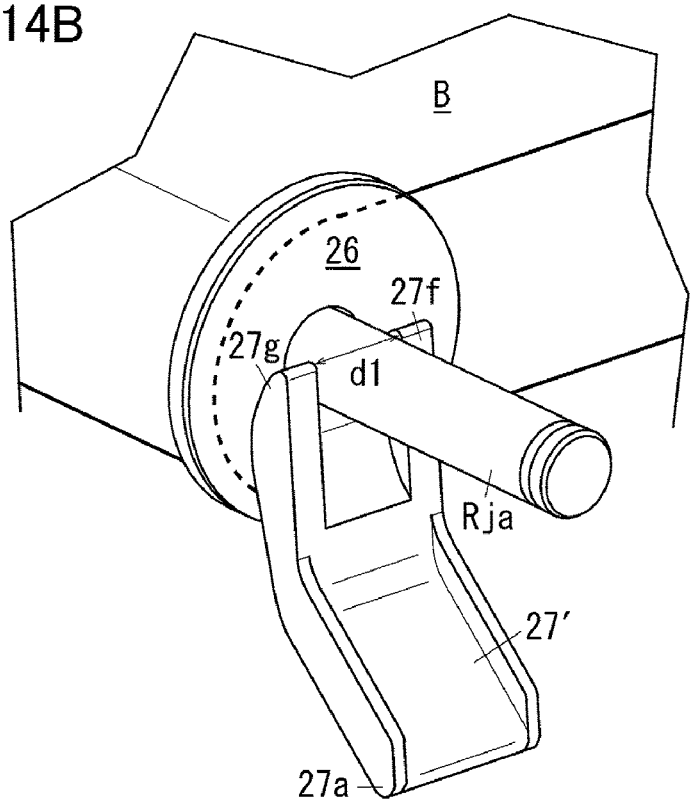

FIGS. 14A and 14B are views illustrating the belt offset sensing member and the shaft displacing member in Example 3 of the invention, FIG. 14A is a sectional perspective view corresponding to FIG. 13A in Example 2, and illustrating a range from the front end portion of the driven roll to the front bearing, and FIG. 14B is an enlarged view illustrating main portions of the belt offset sensing member and the shaft displacing member as seen in the direction of arrow XIVB in FIG. 14A.

Referring to FIG. 14A, in the center supporting recess 32 in Example 3, a plate-like upper end wall 32*d* which rearward extends from the upper end of the front end wall 32*a*, and which is an example of an upstream movement restricting face, and a plate-like lower end wall 32*e* which rearward extends from the lower end of the front end wall 32*a*, and which is an example of a downstream movement restricting face are formed.

The upper end wall 32*d* and the lower end wall 32*e* constitute a movement restricting portion (32*d*+32*e*) in Example 3.

Example 3 is preset so that the length L3 between the upper end wall 32*d* and the lower end wall 32*e*, i.e., the length L3 of the center supporting recess 32 in the upper and lower directions is longer than the length L4 of the shaft displacing member 27' in the upper and lower directions in which the swing center 27*a* extends. Namely, the width of the center supporting recess 32 in the upper and lower directions is formed to be larger than that of the shaft displacing member 27' in the upper and lower directions.

As a result, a center supporting portion 32*c*1' which is a corner portion formed by the front end wall 32*a* in Example 3 and the inner wall 32*c* is set so that the length in the upper and lower directions is longer than that of the center supporting portion 32*c*1 in Example 2. As shown in FIG. 14B, therefore, the swing center 27*a* which is butted against the center supporting portion 32*c*1' to be supported is supported so as to be movable in the upper and lower directions along which the center supporting portion 32*c*1' extends.

The shaft displacing member 27' in Example 3 is preset so that the gap d1 between the upper and lower contacting portions 27*f*, 27*g*, i.e., the gap d1 of the recess 27*d* in the upper and lower directions is equal to the outer diameter of the driven shaft Rja. Namely, the driven shaft Rja in Example 3 is interposed between the upper and lower contacting portions 27*f*, 27*g* in a state where a gap larger than play does not exist therebetween.

Function of Example 3

In the thus configured printer U which is an example of the image forming apparatus of Example 3, as shown in FIG. 14B, the swing center 27*a* of the shaft displacing member 27' is supported so as to be movable in the upper and lower directions.

In Example 3, there is the possibility that, between the cases shown in FIGS. 7 and 8 where the full-color mode is performed, and where the monochromatic mode is performed, the distribution of the tension of the medium conveying belt B is changed, and rattling, uneven rotation, or the like occurs in the medium conveying belt B. In the case where the medium conveying belt B is configured by elastic rubber, for example, there is the possibility that the circumferential length of the medium conveying belt B is expanded/contracted by a change of environment such as the temperature or the humidity, temporal deterioration, or the like. In such a case, in Example 3, the driven roll Rj which stretches the medium conveying belt B in the lower direction may be moved in the upper and lower directions by the stretch springs SPa, SPa.

In the case where the swing center 27*a* is not moved in the upper and lower directions, therefore, there is the possibility that the driven shaft Rja is contacted and pressed against the upper contacting portion 27*f* or the lower contacting portion 27*g* by the movement of the driven shaft Rja in the upper and lower directions, the opposite side of the swing center 27*a* in the movement direction of the driven shaft Rja is separated from the center supporting portion (32*c*1), and the swing center 27*a* is tilted. Therefore, the locus of rotation of the shaft displacing member 27' which is pressed by the driven shaft Rja to be supported in a state where the swing center 27*a* is tilted is deviated from the right direction coincident with the tilting direction of the driven shaft Rja. In this case, when the medium conveying belt B is offset, efficient transmission of the moving force of the members B, 26 as the rotation force of the shaft displacing member 27' is hardly performed. As a result, there is the possibility that the performance of correcting offset of the medium conveying belt B is reduced.

In order to prevent the upper contacting portion 27*f* or the lower contacting portion 27*g* from being contacted with the driven shaft Rja, the gap d1 of the recess 27*d* must be sufficiently long with respect to the moving distance of the driven shaft Rja, and the length of the shaft displacing member 27' in the upper and lower directions must be increased. When the gap d1 is increased, therefore, the width lengths of the belt offset sensing member 26 and the shaft displacing member 27' must be increased in order to ensure the contact range of the belt offset sensing member 26 and the interlocking member contacting portion (27*f*+27*g*).

In the printer U of Example 3, however, the swing center 27*a* is supported so as to be movable in the upper and lower directions. When the interlocking member contacting portion (27*f*+27*g*) is contacted and pressed by the movement of the driven shaft Rja in the upper and lower directions, therefore, the shaft displacing member 27' can be moved in the upper and lower directions interlockingly with the driven shaft Rja.

In the printer U of Example 3, as compared with the case where the swing center 27*a* is not moved in the upper and lower directions, therefore, tilting of the swing center 27*a* due to pressing of the driven shaft Rja is reduced, and the shaft displacing member 27' can be smoothly swung. As a result, in the printer U of Example 3, as compared with the case where the swing center 27*a* is not moved in the upper and lower directions, the performance of correcting offset of the medium conveying belt B is less reduced.

In Example 3, the gap d1 of the recess 27*d* in the upper and lower directions is set to be equivalent to the outer diameter of the driven shaft Rja, and the driven shaft Rja is interposed between the upper and lower contacting portions 27*f*, 27*g* in a state where a gap larger than play does not exist therebetween. As a result, in the printer U of Example 3, the shaft displacing member 27' can be moved in the upper and lower directions interlockingly with movement of the driven shaft Rja in the stretching direction.

Furthermore, the gap d1 is set to be equivalent to the outer diameter. Even when the driven shaft Rja is moved in the upper and lower directions, the contact range of the belt offset sensing member 26 which is passed through the driven shaft Rja, and the interlocking member contacting portion (27*f*+27*g*) in which the driven shaft Rja is interposed can be always ensured in the vicinity of the driven shaft Rja. As a result, in the printer U of Example 3, the lengths of the belt offset sensing member 26 and the shaft displacing member 27' in the upper and lower directions can be shortened, and the whole belt module BM and the whole printer U can be miniaturized.

In Example 3, the movement of the swing center 27*a* in the stretching direction is restricted between the upper end wall 32*d* and the lower end wall 32*e*. Namely, Example 3 is set so that the shaft displacing member 27' is set so as to move in the upper and lower directions between the intersecting-direction most upstream position where the upper end portion is contacted with the upper end wall 32*d*, and the intersecting-direction most downstream position where the lower end portion is contacted with the lower end wall 32*e*.

As a result, in the printer U of Example 3, the movement of the shaft displacing member 27' in the upper and lower directions can be restricted by the movement restricting portion (32*d*+32*e*), and the shaft displacing member 27' can be prevented from moving in the upper and lower directions to drop off from the center supporting recess 32.

In other points, the printer U of Example 3 can attain the same effects as the printer U of Example 2.

(Modifications)

Although, in the above, the examples of the invention have been described in detail, the invention is not restricted to the examples. Various modifications are enabled within the scope of the spirit of the invention set forth in the claims. Modifications (H01) to (H012) of the invention will be exemplified.

(H01) Although, in the examples, the printer has been described as an example of the image forming apparatus, the invention is not restricted to this. The image forming apparatus may be a facsimile apparatus, a copier, or a multi-function apparatus having all of or a plurality of functions of these apparatuses. The invention is not restricted to an electrophotographic image forming apparatus, and the configurations of the examples may be applied to a portion of a medium conveying member in an image forming apparatus of a so-called inkjet recording system.

(H02) Although, in the examples, the photosensitive member Pk for black is placed in the upper end has been exemplarily described, the invention is not restricted to this. The placement position may be arbitrarily changed in accordance with the configuration, the design, and the like.

(H03) Although, in the examples, the movement of the medium conveying belt B is controlled by the functions of the eccentric cam HC and the transfer frame pressing spring SPc, the invention is not restricted to this. An arbitrary configuration which can move the medium conveying belt B may be employed. For example, in place of the eccentric cam HC, a so-called solenoid may be used, and, in place of the transfer frame pressing spring SPc, the weight of the transfer frame Ft itself may be used while adjusting the center of gravity position of the transfer frame Ft.

(H04) Although, in the examples, the image forming apparatus for four colors of Y, M, C, and K has been exemplarily described, the invention is not restricted to an apparatus for four colors. The invention may be applied also to an image forming apparatus for three or less or five or more colors.

(H05) Although, in the examples, the medium conveying belt B has been described as an example of the endless belt-like member, the invention is not restricted to this. For example, the invention may be applied also to endless belt-like members such as an intermediate transfer belt with and from which a belt cleaner and a secondary transferring member are contacted and separated, and which is an example of an intermediate transferring body, and an endless belt-like member such as a photosensitive belt which is an example of an image carrier. Namely, an intermediate transferring device, a transferring device, an image forming apparatus, and the like having the belt module BM which is an example of the offset correcting device of the invention may be configured.

Figure 15:
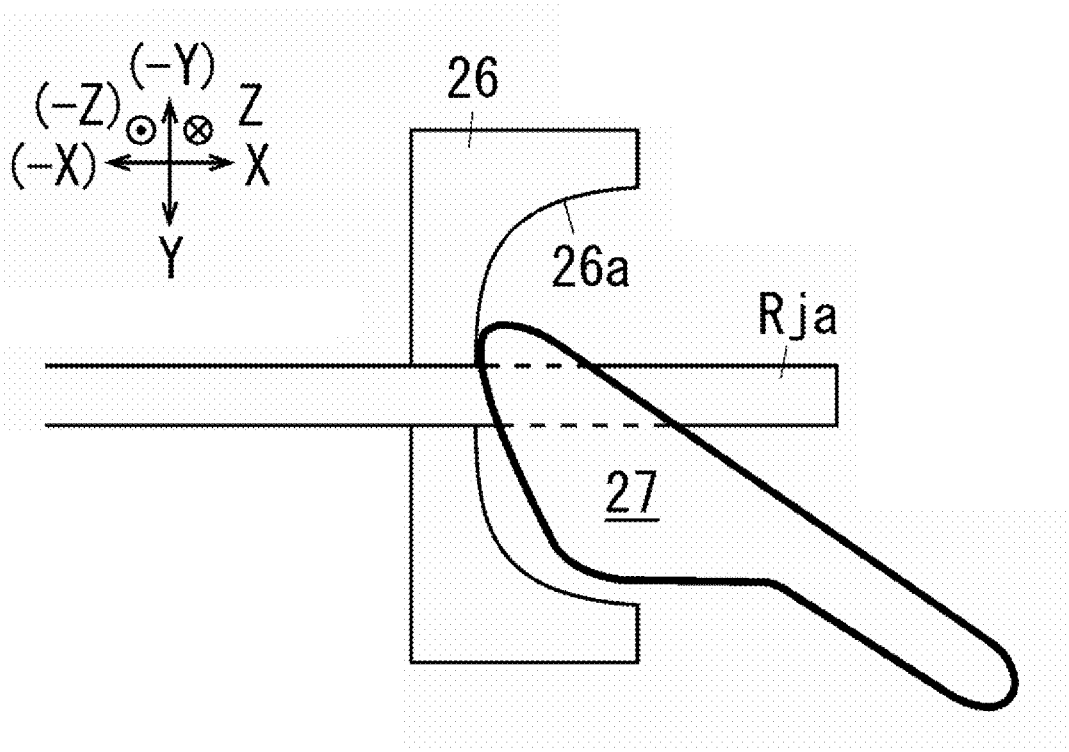
FIG. 15 is an enlarged view illustrating main portions of a modification of the belt offset sensing member.

FIG. 15 is an enlarged view illustrating main portions of a modification of the belt offset sensing member.

(H06) In Example 1, the radius of curvature of the left end faces 27*h* is set so that the contact profile PF is arcuate, and, in contrast to the arcuate contact profile PF in Example 1, the contact profile PF' in Example 2 exhibits an involute curve shape which extends toward the center of the arc, thereby allowing offset of the medium conveying belt B to be easily converged in the vicinity of the balanced position. The invention is not restricted to this. For example, the radius of curvature of the left end faces 27*h* may be set so that, in contrast to the arcuate contact profile PF in Example 1, the contact profile exhibits a cycloidal curve which extends toward the center of the arc, thereby allowing offset of the medium conveying belt B to be easily converged in the vicinity of the balanced position. As shown in FIG. 15, in addition to the radius of curvature of the left end faces 27*h*, a right end face 26*a* functioning as a contacting face of the belt offset sensing member 26 may be formed so that the radius of curvature becomes larger as more advancing from the driven shaft Rja which is the center of the disk, toward the outer circumferential side, whereby the same effects as those of the examples can be attained.

(H07) In the examples, the belt module BM is vertically placed, and hence the swing bracket SB is tilted by urging of the press springs SPb, SPb'. When the belt module BM is horizontally placed, for example, the swing bracket SB may be tilted by its own weight, and the press springs SPb, SPb' may be omitted.

(H08) In the examples, the medium conveying belt B is set so that it is offset only in the front direction, and hence the shaft displacing member 27 or 27' is placed only in the front end portion of the driven shaft Rja. The invention is not restricted to this. For example, the swing bracket SB and the shaft displacing member 27 or 27' may be disposed in both the end portions of the driven shaft Rja, so that offsets of both the width-direction ends of the medium conveying belt B can be corrected.

(H09) In the examples, in accordance with the driven roll Rj which is tilted in the right direction, the shaft displacing member 27 or 27' is placed on the right side of the driven shaft Rja. The invention is not restricted to this. In the case where the driven shaft Rja is set so that one end portion is tilted with respect to the other end portion, for example, the shaft displacing member 27 or 27' may be set so as to be tilted in the direction opposite to that of tilting which is set in the one end portion of the driven shaft Rja with respect to the other end portion.

(H010) In Example 1, the swing center 27*a* of the shaft displacing member 27 is formed to have an oval section shape by the pair of cutout faces 27*a*1, 27*a*2. The invention is not restricted to this. Even when a D-like section shape or a so-called D-cut shape is formed by only one cutout face 27*a*1, for example, the swing center can be inserted into the cutout insertion portion 9*b* in a state where the posture of the shaft displacing member is fit into the cutout insertion portion 9*b* of the groove portion 9.

(H0111) In Example 1, the configuration is preferably employed where the swing center 27*a* of the shaft displacing member 27 is fit from the outside of the swing range AR2 into the cutout insertion portion 9*b* to prevent the shaft displacing member 27 from dropping off the groove portion 9 during a swinging operation. The invention is not restricted to this. For example, a drop-off preventing member which closes the cutout insertion portion 9*b* may be used to prevent the shaft displacing member 27 from dropping off the groove portion 9. Alternatively, the configuration for preventing drop-off may be omitted.

(H012) In the examples, the left end faces 27*h* may be set so as to have an arcuate shape having the same diameter as the arcuate locus of the contact profile PF in Example 1.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An offset correcting device comprising:

an endless belt-like member having an endless belt-like shape;

a rotation supporting member that has a rotation shaft in which an axial direction extends along a width direction of the endless belt-like member, and that is rotated while supporting the endless belt-like member;

an interlocking member that is supported by one end portion of the rotation shaft to be movable along the axial direction, and that is capable of being contacted with a width direction edge of the endless belt-like member; and a shaft displacing member that has: a swing center that is placed at a position deviated from the rotation shaft and that intersects with the axial direction; a rotation shaft contacting portion that is contacted with the one end portion of the rotation shaft of the rotation supporting member; and an interlocking member contacting portion that is contacted with the interlocking member and that is movable integrally with the rotation shaft contacting portion, wherein, when the interlocking member is pressed against the width direction edge of the endless belt-like member that is moved to one end side of the rotation shaft, the interlocking member contacting portion and the rotation shaft contacting portion are swung about the swing center, and the rotation shaft contacting portion tilts the rotation shaft in a tilting direction coincident with a direction along which the endless belt-like member is moved toward another end of the rotation shaft.

2. The offset correcting device according to claim 1, wherein, in the shaft displacing member, the rotation shaft contacting portion extends from the swing center toward the rotation supporting member, and the interlocking member contacting portion extends from the swing center toward the interlocking member.

3. The offset correcting device according to claim 1, wherein, in the interlocking member contacting portion, a contacting face with the interlocking member is formed so that, in a case where a line in the width direction of the endless belt-like member before the endless belt-like member is moved toward the one end of the rotation shaft is indicated by a width direction line, a line segment of the shaft displacing member connecting from the swing center to an interlocking member contacting position where the interlocking member contacting portion and the interlocking member are contacted with each other is indicated by a shaft displacement line segment, a length of the shaft displacement line segment is indicated by L, an angle formed by the width direction line and the shaft displacement line segment before the endless belt-like member is moved toward the one end of the rotation shaft is indicated by $\theta_0$, an increment of the angle $\theta_0$ after the endless belt-like member is moved toward the one end of the rotation shaft is indicated by $\theta$, a moving distance of the endless belt-like member in the width direction is indicated by Lx, and a moving distance of the rotation shaft in the tilting direction is indicated by Ly, following expressions hold:

$$Lx=L(\cos(\theta_0)-\cos(\theta_0+\theta))$$

$$Ly=L(\sin(\theta_0+\theta)-\sin(\theta_0)).$$

4. The offset correcting device according to claim 1, wherein the interlocking member contacting portion has a contact face formed into an arcuate shape having a same diameter as an arcuate locus of a contact point with respect to the interlocking member.

5. The offset correcting device according to claim 1, wherein the interlocking member contacting portion has a contact face having a radius of curvature which is more increased as the contact face further advances from a pre-movement interlocking member contact position with which, before the endless belt-like member is moved toward the one end of the rotation shaft, the interlocking member is contacted, toward a post-movement interlocking member contact position with which, after the endless belt-like member is moved toward the one end of the rotation shaft, the interlocking member is contacted.

6. The offset correcting device according to claim 1, wherein the interlocking member has a contact face having a radius of curvature which is more increased as the contact face further advances from a pre-movement contacting portion contact position with which, before the endless belt-like member is moved toward the one end of the rotation shaft, the interlocking member contacting portion is contacted, toward a post-movement contacting portion contact position with which, after the endless belt-like member is moved toward the one end of the rotation shaft, the interlocking member contacting portion is contacted.

7. The offset correcting device according to claim 1, wherein the rotation shaft is formed into a columnar shape, and the rotation shaft contacting portion is configured by a plate-like member which extends in a direction intersecting with the axial direction of the rotation shaft, and configured by a convex arcuate face along the axial direction of the rotation shaft.

8. The offset correcting device according to claim 1, wherein the device further comprises:

a first frame which rotatably supports the rotation shaft of the rotation supporting member, and which supports the endless belt-like member and interlocking member that are supported by the rotation shaft; and a second frame having a frame mounting portion by which the first frame is detachably supported, and a center mounting portion by which the swing center of the shaft displacing member is swingably and detachably supported, the second frame supporting the first frame and the shaft displacing member.

9. The offset correcting device according to claim 8, wherein the swing center has a cutout face in which an outer surface of the column is partly cutout, the cutout face being formed by a cutout distance in which a distance between the cutout face and a circumferential outer surface that is opposite across a center of the column is shorter than a diameter of the column, and the center mounting portion has: an inner circumferential face which swingably supports the columnar swing center having the cutout face; and a cutout insertion portion which is configured by an opening that extends in a radial direction of the inner circumferential face, and that connects the inner circumferential face with an outside, the cutout insertion portion having an opening width, the opening width being formed outside of a swing range where the swing center swings, the swing range corresponding to a movement range of the interlocking member contacting portion, and extending between a pre-movement contacting portion contact position with which, before the endless belt-like member is moved toward the one end of the rotation shaft, the interlocking member contacting portion is contacted, and a maximum post-movement contacting portion contact position with which, after the endless belt-like member is moved at a maximum degree toward the one end of the rotation shaft, the interlocking member contacting portion is contacted, the opening width being larger than the cutout distance and smaller than the diameter of the column.

10. An intermediate transferring device comprising:

an intermediate transferring body configured by an endless belt-like member having an endless belt-like shape, an outer surface of the endless belt-like member being passed through a region opposed to an image carrier which holds an image, along a rotation direction;

an intermediate transferring member which is placed on a side of a rear face of the endless belt-like member, and in an intermediate transferring region opposed to the image carrier through the endless belt-like member, and which transfers the image held on the image carrier to the outer surface of the endless belt-like member; and an offset correcting device according to claim 1, the device correcting offset of the intermediate transferring body.

11. A transferring device comprising:

an intermediate transferring device according to claim 10 in which an image held by an image carrier is transferred to an outer surface of an endless belt-like intermediate transferring body, an outer surface of the body being opposed to the image carrier; and a final transferring member which transfers the image transferred to the outer surface of the intermediate transferring body, to a final transferring body.

12. An image forming apparatus comprising:

an image carrier in which a latent image is formed on a surface;

a developing device which develops the image on the surface of the image carrier, to an image in the form of a visible image;

a transferring device according to claim 11 which transfers the image on the surface of the image carrier, to a medium; and a fixing device which fixes the image on a surface of the medium.

* * * * *